US008136990B2

(12) United States Patent
Piucci et al.

(10) Patent No.: US 8,136,990 B2
(45) Date of Patent: Mar. 20, 2012

(54) INFLATABLE MAILER, APPARATUS AND METHOD FOR PREPARING THE SAME

(75) Inventors: Vincent A. Piucci, Spencer, MA (US); Michael J. Schamel, Wilmont, NH (US); Walter C. Sadakierski, Shrewsbury, VT (US)

(73) Assignee: Sealed Air Corporation (US), Saddle Brook, NJ (US)

( * ) Notice: Subject to any disclaimer, the term of this patent is extended or adjusted under 35 U.S.C. 154(b) by 113 days.

(21) Appl. No.: 12/606,289

(22) Filed: Oct. 27, 2009

(65) Prior Publication Data

US 2010/0043353 A1 Feb. 25, 2010

Related U.S. Application Data

(62) Division of application No. 11/047,306, filed on Jan. 31, 2005, now Pat. No. 7,621,104.

(51) Int. Cl.

| | |
|---|---|
| ***B65D 33/00*** | (2006.01) |
| ***B65D 33/24*** | (2006.01) |
| ***B65D 33/01*** | (2006.01) |
| ***B65D 81/02*** | (2006.01) |

(52) U.S. Cl. ..... 383/3; 383/84; 383/103; 206/522

(58) Field of Classification Search ..... 383/3, 103, 383/84; 206/522

See application file for complete search history.

(56) References Cited

U.S. PATENT DOCUMENTS

| | | | | |
|---|---|---|---|---|
| 3,382,642 A | | 5/1968 | Shaw | |
| 4,096,306 A | | 6/1978 | Larson | |
| 4,136,502 A | | 1/1979 | Shore | |
| 4,209,886 A | | 7/1980 | Winter et al. | |
| 4,285,998 A | | 8/1981 | Thibodeau | |
| 4,465,188 A | | 8/1984 | Soroka et al. | |
| 4,551,379 A | * | 11/1985 | Kerr | 428/200 |
| 4,597,244 A | | 7/1986 | Pharo | |
| 4,869,939 A | * | 9/1989 | Santo | 428/35.2 |
| 4,872,558 A | | 10/1989 | Pharo | |

(Continued)

FOREIGN PATENT DOCUMENTS

DE 42 19 258 A1 10/1993

(Continued)

OTHER PUBLICATIONS

Sealing, Heat: *The Wiley Encyclopedia of Packaging Technology, Second Edition*, pp. 823-827.

*Primary Examiner* — Jes F Pascua
(74) *Attorney, Agent, or Firm* — Alston & Bird LLP

(57) ABSTRACT

The invention is an inflatable mailer having a liner that can be inflated at the point of use. The liner includes a series of inflatable chambers that are in fluid communication with a common channel. A controlled volume of gas is disposed in the liner. The gas is sufficient to inflate the common channel but is not sufficient to appreciably inflate the inflatable chambers. As a result, the inflatable mailer is in a relatively compact state. The invention includes an apparatus for inflating the mailer. The apparatus includes a nip for moving the controlled volume of gas into the common channel; an inflation nozzle adapted to pierce the inflated common channel and introduce a second portion of gas into the liner until the liner is inflated to a desired level; and a sealing device to seal the inflated liner.

20 Claims, 19 Drawing Sheets

U.S. PATENT DOCUMENTS 4,874,093 A 10/1989 Pharo
4,877,334 A 10/1989 Cope
4,918,904 A 4/1990 Pharo
4,949,530 A 8/1990 Pharo
5,070,675 A 12/1991 Chuan-Shiang
5,129,519 A * 7/1992 David et al. ..... 206/523
5,263,587 A * 11/1993 Elkin et al. ..... 206/522
5,272,856 A 12/1993 Pharo
5,273,361 A 12/1993 Jillson
5,346,312 A 9/1994 Mabry et al.
5,447,235 A 9/1995 Pharo
5,454,642 A 10/1995 De Luca
5,535,888 A * 7/1996 De Luca ..... 206/522
5,581,983 A 12/1996 Murakami
5,588,532 A 12/1996 Pharo
5,639,523 A 6/1997 Ellis
5,692,607 A 12/1997 Brosmith et al.
5,826,723 A * 10/1998 Jaszai ..... 206/522
5,833,058 A 11/1998 Mabry
5,937,614 A 8/1999 Watkins et al.
5,942,076 A 8/1999 Salerno et al.
RE36,501 E 1/2000 Hoover et al.
RE36,759 E 7/2000 Hoover et al.
6,139,188 A 10/2000 Marzano
6,283,296 B1 * 9/2001 Newman ..... 206/522
6,410,119 B1 6/2002 De Luca et al.
6,423,166 B1 7/2002 Simhaee
6,565,946 B2 5/2003 Perkins et al.
6,571,954 B2 6/2003 Nadler
6,598,373 B2 7/2003 Sperry et al.
6,637,177 B1 10/2003 Trillich et al.
6,758,026 B2 7/2004 Davey
6,761,960 B2 7/2004 De Luca et al.
6,789,376 B1 9/2004 Greenwood et al.
6,883,665 B1 4/2005 Ahn
7,106,202 B2 9/2006 Dickinson
7,108,650 B2 9/2006 Marzano
7,297,387 B2 * 11/2007 Koyanagi ..... 428/166
7,621,104 B2 * 11/2009 Piucci et al. ..... 53/79
2002/0134049 A1 9/2002 Simhaee
2002/0136858 A1 9/2002 Simhaee
2002/0166788 A1 11/2002 Sperry et al.
2003/0037858 A1 2/2003 Kannankeril et al.
2003/0062286 A1 4/2003 Igarashi
2003/0094394 A1 5/2003 Anderson et al.
2003/0094395 A1 5/2003 Peper et al.
2003/0109369 A1 6/2003 Lerner et al.
2003/0163976 A1 9/2003 Perkins et al.
2004/0101658 A1 5/2004 Kannankeril et al.
2004/0101659 A1 5/2004 Kannankeril et al.
2004/0134164 A1 7/2004 Perkins et al.
2004/0171469 A1 9/2004 Brandolini et al.
2004/0206050 A1 10/2004 Fuss et al.
2004/0231291 A1 11/2004 Slovencik et al.
2005/0013974 A1 * 1/2005 Koyanagi ..... 428/178
2005/0022467 A1 2/2005 Kujubu et al.
2010/0281831 A1 * 11/2010 Kannankeril et al. ..... 53/432
2010/0282824 A1 * 11/2010 Kannankeril et al. ..... 229/68.1
2011/0068154 A1 * 3/2011 Kannankeril et al. ..... 229/68.1
2011/0120899 A1 * 5/2011 Sorensen ..... 206/522

FOREIGN PATENT DOCUMENTS

DE 296 00 373 U1 2/1996

* cited by examiner

INFLATABLE MAILER, APPARATUS AND METHOD FOR PREPARING THE SAME

CROSS REFERENCE TO RELATED APPLICATIONS

This application is a divisional application of U.S. application Ser. No. 11/047,306, filed Jan. 31, 2005, now U.S. Pat. No. 7,621,104, which is hereby incorporated herein in its entirety by reference.

BACKGROUND OF THE INVENTION

The invention relates generally to mailers for shipping objects and more particularly to mailers having an air cellular cushion liner.

Consumers frequently purchase goods from mail order or internet retailers. According to Gartner, a leading provider of research and analysis on the global IT industry, e-commerce transactions in 2004 will hit $60 billion in the U.S. alone, the highest total ever. As a result, millions of packages are being shipped each day.

Many of these packages include small items such as pharmaceuticals, books, medical supplies, electronic parts, and the like. These items are normally packaged in small containers such as a box or envelope. To protect the items during shipment, they are typically packaged with some form of protective dunnage that may be wrapped around the item or stuffed into the container to prevent movement of the item and to protect against shock.

One common packaging method uses corrugated boxes to hold the items to be shipped. The void spaces between the items and the inside walls of the box are filled with void-filling dunnage such as foam "peanuts," air cellular cushioning materials, crumpled or shredded paper, and other air filled packaging materials. Typically, the corrugated boxes are supplied to the shipper in a collapsed condition so that the boxes occupy less space. Each box must then be erected and taped before use by the shipper which may result in additional labor costs for shipping. The shipper typically maintains a supply of collapsed boxes for subsequent use.

The void-filling dunnage must also be delivered to the shipper. The shipper normally warehouses a supply of dunnage for future use. Conventional dunnage materials such as air cellular material or "peanuts" are comprised mostly of air. Shipping costs associated with these packaging materials are generally based on volume rather than weight, resulting in increased transportation costs. Paper dunnage is more economical to ship, but requires additional labor to make it useable as dunnage. As a result, these dunnage materials can increase costs that are associated with shipping items.

Another type of common shipping method includes the use of a padded mailer. Padded mailers are generally shipping envelopes that have padded walls to protect the contents of the mailer. Some padded mailers are constructed of a double wall envelope with paper dunnage between the walls. These mailers are generally made with paper envelopes. Another type of mailer has air cellular material lining the inside surfaces of the envelope. These envelopes can be made of paper or plastic such as Tyvek®. Similar to "peanuts" and air cellular materials, these padded mailers are typically comprised mostly of air. They are normally expensive to deliver to the shipper, and require a large storage space. The padded mailers are typically limited to relatively thin padding so that their size is both practical and economic. As a result, the protective capabilities of the padded envelopes may be limited.

In a method similar to the padded mailer, the item may be wrapped in air cellular material and then inserted into a shipping envelope. This method requires the purchase and storage of both a shipping envelope and a supply of air cellular material.

Additional methods of providing protective dunnage include the use of polyurethane foam cushions and air cushions that are prepared on-site. These methods typically require the use of more expensive equipment and additional space to locate the equipment near the point of packaging.

Thus, there exists a need for providing a shipping container for the shipment of small items that requires less storage space and is economical.

BRIEF SUMMARY OF THE INVENTION

The invention comprises an inflatable mailer having a pouch and an inflatable liner disposed in the interior of the pouch. The inflatable liner includes a controlled volume of gas that is dispersed throughout a series of inflatable chambers and one or more common channels that are interconnected to the series of inflatable chambers. Typically, the common channel extends longitudinally along an edge of the liner. The volume of gas in the inflatable liner is sufficient to inflate the common channel when the gas is moved from the inflatable chambers into the common channel, but when dispersed, the gas volume is not sufficient to inflate the liner to an appreciable extent. As a result, the inflatable liner is in a substantially flat state when the gas is dispersed throughout the liner. The inflatable mailers can be inflated at the point of use. The inflatable mailers can be shipped in a relatively compact state that occupies significantly less space than a corresponding inflated mailer.

The invention also includes an apparatus for inflating the mailer. In one embodiment of the invention, the apparatus includes a conveying mechanism for conveying an inflatable mailer along a longitudinal pathway. The longitudinal pathway includes a nip through which the inflatable mailer is driven. Preferably, the inflatable mailer is positioned on the conveying mechanism so that the common channel is disposed at the trailing edge of the mailer as it passes between the nip. Passage of the inflatable mailer through the nip moves the controlled volume of gas from the inflatable chambers and into the common channel thereby causing the channel to inflate. The inflated channel forms an expanded space within the liner. An inflation needle then punctures the pouch and enters the now inflated common channel. Gas is introduced into the channel via the inflation needle. A sealing device seals the liner closed to prevent gas from escaping after the liner has been inflated to a desired level.

In one embodiment, the nip comprises a drive roll and a driven roll that cooperate together to form a nip therebetween. In a preferred embodiment, the driven roll includes an indexing mechanism that is used to position a sealing device, such as a resistive wire, between the drive roll and the driven roll. The inflatable mailer is driven between the rolls until the common channel is inflated with gas. Forward travel of the inflatable mailer is then stopped and an inflation needle pierces the common channel to introduce gas into the liner. The resistive wire seals the liner by fusing the liner material together.

The inflatable liner provides an effective method of preparing a shipping container that can be easily inflated and used at a point of packaging. The inflatable mailers typically occupy less volume than conventional packaging materials resulting in possible savings in transportation costs and a reduction in the amount of space that is typically required for storage. Thus, the invention provides an inflatable mailer and device for inflating the same that overcomes many of the disadvantages that are associated with conventional packaging materials.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

The present invention now will be described more fully hereinafter with reference to the accompanying drawings, in which some, but not all embodiments of the inventions are shown. Indeed, the invention may be embodied in many different forms and should not be construed as limited to the embodiments set forth herein; rather, these embodiments are provided so that this disclosure will satisfy applicable legal requirements. Like numbers refer to like elements throughout.

Figures 1A, 1B:
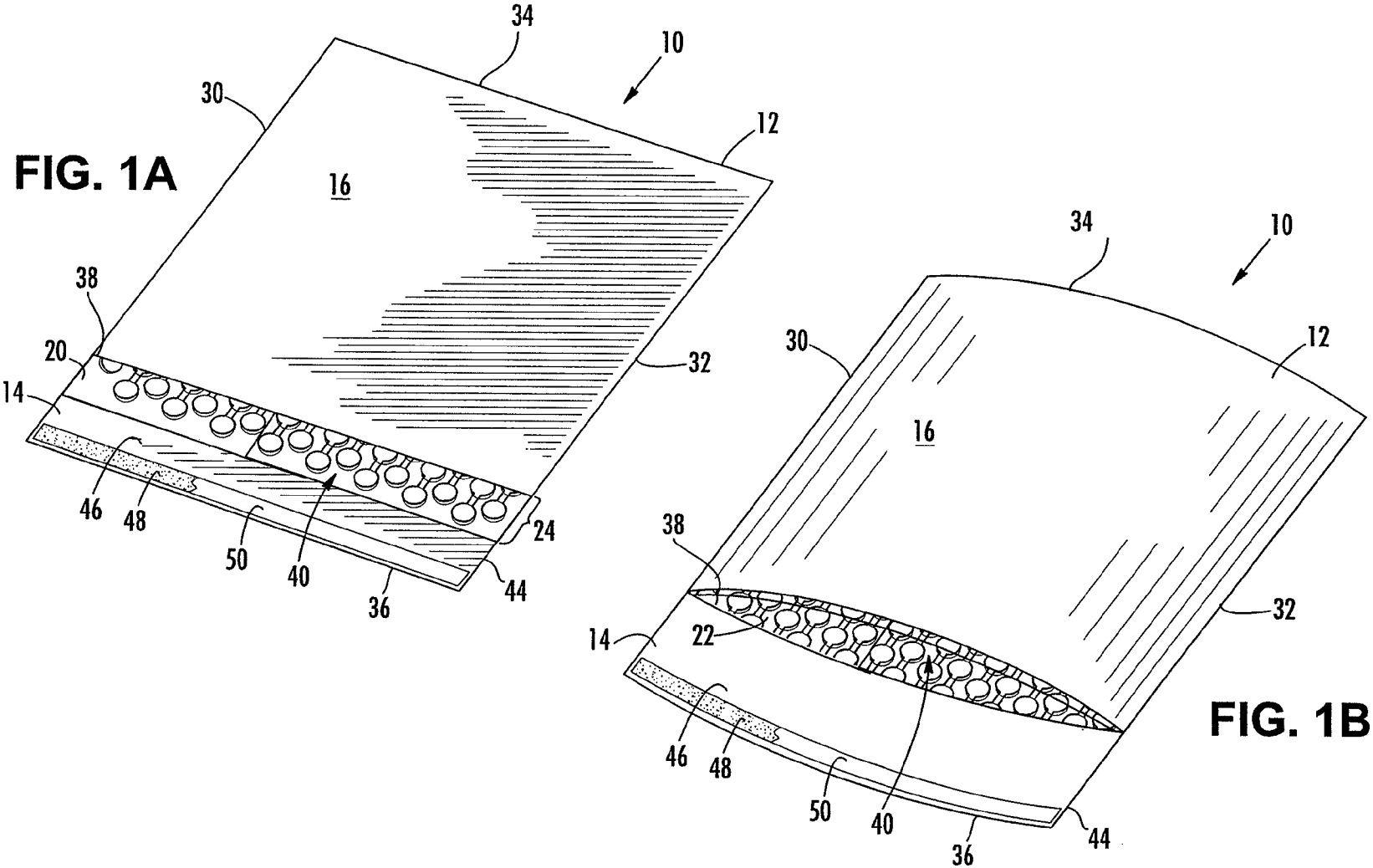
FIG. 1A is a graphical illustration of an inflatable mailer in an uninflated state.
FIG. 1B is a graphical illustration of the inflatable mailer of FIG. 1A after it has been inflated.

With reference to FIGS. 1A and 1B, an inflatable mailer in accordance with the invention is illustrated and broadly designated as reference number 10. As shown in FIG. 1A, the inflatable mailer comprises a pouch 12 having an inflatable liner 20 disposed in the interior of the pouch. The inflatable liner 20 typically comprises a web of air cellular cushioning material that can be inflated at a desired time. As shown in FIG. 1A, the inflatable liner 20 may be manufactured and transported in a relatively compact and uninflated state. As a result, the volume occupied by the inflatable mailer may be substantially less than the volume occupied by a corresponding inflated mailer (see FIG. 1B). The inflatable liner 20 may be inflated at the point of packaging or at some other suitable location. In this regard, FIG. 1B illustrates an inflatable mailer 10 having an inflated liner 22 disposed in the interior of the pouch 12. As shown in FIG. 1B, the volume of space occupied by the inflated liner is substantially increased.

The pouch 12 comprises a front sheet 14 and a rear sheet 16 that are oriented face-to-face and affixed to each other at side edges 30, 32 and bottom edge 34. Preferably, each of the side edges and bottom edge are permanently sealed. In some embodiments the front and rear sheets may comprise two separate sheets, or alternatively, a single sheet that has been center-folded at bottom edge 34. Together the sheets define pouch 12 having an interior space for receiving an article and a pouch opening 40 through which an article can be placed into the interior of the pouch.

In some embodiments, the inflatable mailer may also include a flap 44 that is adjacent to the opening of the pouch. The top edge 36 of flap 44 extends from the front sheet 14 beyond the top edge 38 of the rear sheet along the opening 40 of the pouch. The flap 44 in some embodiments may merely be a continuous extension of front sheet 14. The flap 44 has an inner surface 46 facing in the direction of the rear sheet 16.

In some embodiments, a sealing agent 48, such as a pressure sensitive adhesive, is disposed at least partially on the inner surface 46 of the flap 44. The sealing agent may comprise a variety of materials including, but not limited to, adhesive or paste, tape, and similar materials that are suitable for sealing the opening of the pouch.

The inflatable mailer 10 may also comprise a release liner for protecting the sealing agent 48 from premature contact with objects or other portions of the mailer. In this regard, FIGS. 1A and 1B illustrate an inflatable mailer having a release liner 50 covering the sealing agent. The release liner is releasably adhered to the sealing agent and protects the sealing agent before use. At a desired time, the release liner 50 can be removed to expose the sealing agent. The pouch opening 40 can then be sealed closed by folding the flap 44 and pressing the sealing agent into sealing contact with the outer surface of the rear sheet.

The material from which the pouch may be formed comprises a wide variety of materials including, but not limited to, thermoplastic material, cardboard, paperboard, paper, foil, or the like. In some embodiments, the front and rear sheets 14, 16 comprise flexible films, each of which film includes a heat sealable thermoplastic material forming at least one surface of the film. The films are positioned with their thermoplastic surfaces in a face-to-face orientation. The edges 30, 32, 34 of the pouch can be attached to each other using a variety of bonding techniques including, for example, a heat seal. Alternatively, edges 30, 32, 34 may be adhesively bonded to each other. Heat seals are preferred and, for brevity, the term "heat seal" is generally used hereinafter. This term should be understood, however, to include the formation of seals by adhesion of edges 30, 32, 34 the front and rear sheet to each other with an adhesive, thermal, ultrasonic fusion, radio frequency, or other suitable sealing method.

Figure 2A:
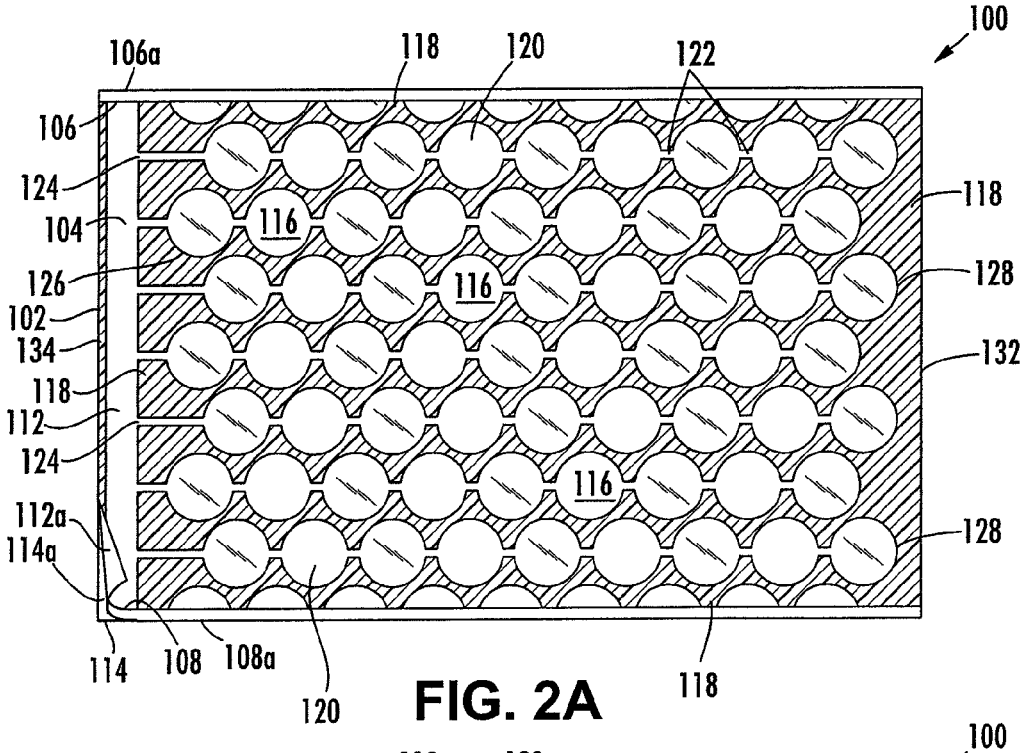
FIGS. 2A and 2B are graphical illustrations of inflatable liners.

The inflatable liner 20 typically comprises an inflatable web that can be inflated to provide cushioning material to protect articles during shipment. Such inflatable webs include air cellular cushioning such as Inflatable Bubble Wrap® cushioning material that is available from Sealed Air Corporation. As shown in FIG. 2A, the inflatable liner 20 comprises an inflatable web 100 comprising two sheets 112 and 114 having respective inner surfaces 112*a* and 114*a* attached to each other in a pattern defining a series of inflatable chambers 116. Each inflatable chamber is in fluid communication with at least one common channel 104. Typically, the common channel extends laterally along one edge of the inflatable liner. The common channel 104 is created from seal 102 that extends along an edge 134 of the liner. Seals 106, 108 sealably close the common channel 104 at each end of the inflatable liner after the last complete inflation chamber. In alternative embodiments, the common channel may be sealed along its edges with a seal that extends along the length of side edges 106*a*, 108*a*. The common channel provides an inflation pathway through which a gas can be introduced to fill the series of inflatable chambers.

Preferably, the inflatable liner also includes a controlled volume of gas that is introduced into the interior of the inflatable liner 20 prior to inserting the liner into the pouch. Typically, the controlled volume of gas is introduced into the inflatable liner during the manufacturing process before the common channel is sealed. The volume of gas should be sufficient to substantially fill the common channel, but should be insufficient to inflate the series of inflatable chambers 116 so that the inflatable mailer is in a relatively compact state during transport and storage. Since the inflatable chambers are interconnected by the common channel, the volume of air in the controlled volume of gas can be evenly distributed throughout the liner. The controlled volume of gas has minimal contribution to the overall thickness of the liner, typically about 0.1 inches or less. Preferably, the volume of gas initially present in the inflatable chambers and common channel is sufficient to inflate the common channel when substantially all the controlled volume of gas is moved from the inflatable chambers into the common channel. Moving all the gas into the common channel causes the common channel to fill and expand. As a result, the gas moved into the common channel creates an interior space within the channel, also referred to as an "inflation pathway," through which one or more gas inflation needles can be inserted into the common channel. As discussed in greater detail below, the inflation pathway is typically formed by passing the inflatable mailer through a nip that moves the controlled volume of gas into the common channel. One or more gas inflation needles may then pierce the pouch and the common channel to introduce a second portion of gas into the liner. The second portion of gas may then flow from the common channel into the series of inflatable chambers. After the chambers are filled to a desired thickness, the liner can then be sealed to prevent the escape of the second portion of gas (see FIG. 2B).

Typically, the inflatable chambers 116 are a predetermined length "L." Length L may be substantially the same for each of the chambers 116, with adjacent chambers being off-set from one another as shown in order to arrange the chambers in close proximity to one another.

In some embodiments, sheets 112 and 114 are sealed to each other in a pattern of seals 118 that defines the inflatable chambers 116 such that each of the chambers has at least one change in width over their length L. That is, seals 118 may be patterned to provide in each chamber 116 a series of sections 120 of relatively large width connected by relatively narrow passageways 122. When inflated, sections 120 may provide essentially spherical bubbles in web 100 by symmetrical outward movement of those sections of sheets 112 and 114 comprising the walls of sections 120. This will generally occur when sheets 112 and 114 are identical in thickness, flexibility, and elasticity. Sheets 112 and 114 may, however, be of different thickness, flexibility or elasticity such that inflation will result in different displacement of sheets 112 and 114, thereby providing hemispherical or asymmetrical bubbles.

Figure 2B:
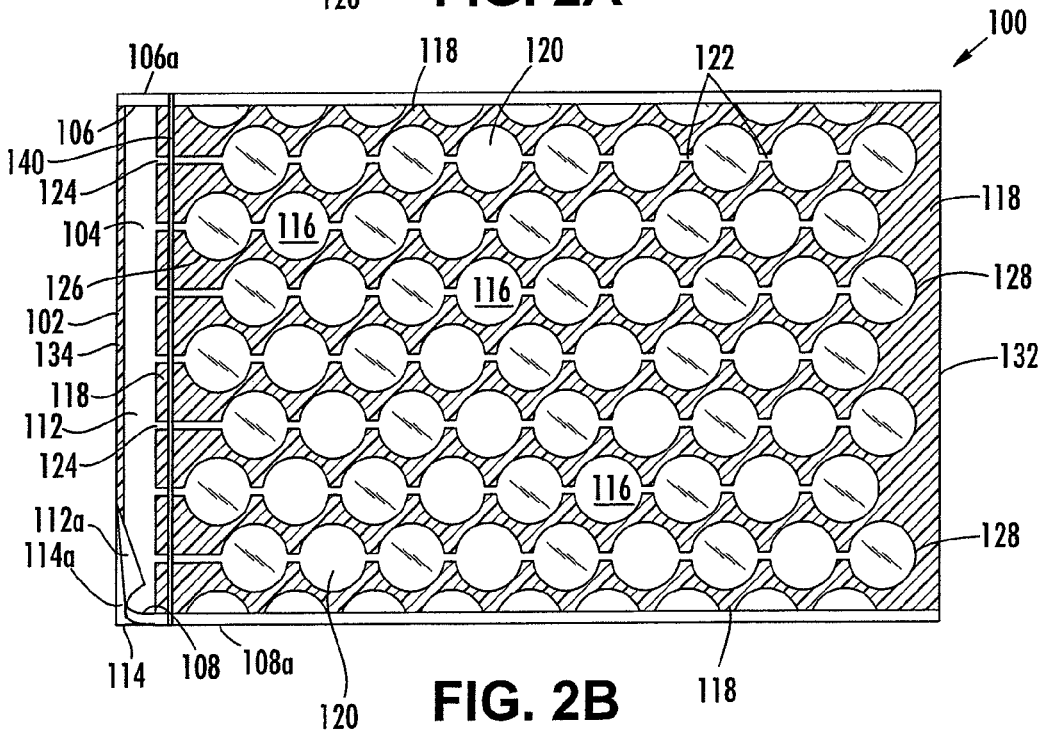

In some embodiments, seals 118 are also patterned to provide inflation conduits 124, which are located at proximal end 126 of each of the inflatable chambers 116 in order to provide fluid communication between the chambers and the common channel. Opposite to the proximal end 126 of each chamber is a closed distal end 128. As shown, seals 118 at proximal end 126 are intermittent, with inflation conduits 124 being formed therebetween. Preferably, inflation conduits 124 are narrower in width than the inflatable sections 120 of relatively large width in order to minimize the size of the seal required to close off the series of inflatable chambers 116 after inflation thereof. In this regard, FIG. 2B illustrates an inflated liner 22 having a seal 140 that extends transversely across each inflation conduit 124. Typically, seal 140 is created after the inflatable chambers have been inflated. Seal 140 prevents gas from escaping from the chambers through the opening created by the gas inflation needle, which is discussed in greater detail below.

Preferably, the seal pattern of seals 118 provides uninflatable planar regions between inflatable chambers 116. These planar regions serve as flexible junctions that may advantageously be used to bend or conform the inflated web about a product in order to provide optimal cushioning protection. In another embodiment, the seal pattern can comprise relatively narrow seals that do not provide planar regions. These seals serve as the common boundary between adjacent chambers. Such a seal pattern is shown for example in U.S. Pat. No. 4,551,379, the disclosure of which is incorporated herein by reference. The seals 118 may be heat seals between the inner surfaces of the sheets 112 and 114. Alternatively, sheets 112 and 114 may be adhesively bonded to each other. Heat seals are preferred and, for brevity, the term "heat seal" is generally used hereinafter. This term should be understood, however, to include the formation of seals 118 by adhesion of sheets 112 and 114 as well as by heat sealing. Preferably, sheets 112 and 114 comprise a thermoplastic heat sealable polymer on their inner surface such that, after superposition of sheets 112 and 114, web 100 can be formed by passing the superposed sheets beneath a sealing roller having heated areas that correspond in shape to the desired pattern of seals 118. The sealing roller applies heat and forms seals 118 between sheets 112 and 114 in the desired pattern, and thereby also forms chambers 116 and common channel 104 with a desired shape. The sealing pattern on the sealing roller also provides intermittent seals at proximal end 126, thus forming inflation conduits 124 and also common channel 104. Further details concerning this manner of making web 100 are disclosed in commonly-assigned, copending patent application Ser. No. 10/057,067 entitled APPARATUS AND METHOD FOR FORMING INFLATED CHAMBERS, (C. Sperry et al.), filed on Jan. 25, 2002, and in U.S. Pat. No. 6,800,162, the disclosures of which are hereby incorporated herein by reference.

Heat sealability of sheets 112 and 114 can be provided by employing a monolayer sheet comprising a heat sealable polymer or a multilayer sheet comprising an inner layer comprising a heat sealable polymer. In either case, inflation conduits 124 preferably also comprise inner surfaces that are heat sealable to one another to allow such conduits to be closed by heat sealing means after inflation of the inflatable chambers, as described in further detail below.

Sheets 112 and 114 may initially be separate sheets that are brought into superposition and sealed or they may be formed by folding a single sheet onto itself with the heat sealable surface facing inward. The longitudinal edge opposite from the common channel 104, shown as edge 132 in FIG. 2A, is closed. Closed edge 132 may be formed in the web as a result of folding a single sheet to form sheets 112 and 114, whereby the fold constitutes edge 132, or by sealing individual sheets 112 and 114 in the vicinity of the longitudinal edge as part of the pattern of seals 118.

Sheets 112, 114 may, in general, comprise any flexible material that can be manipulated to enclose a gas in chambers 116 as herein described, including various thermoplastic materials, e.g., polyethylene homopolymer or copolymer, polypropylene homopolymer or copolymer, etc. Non-limiting examples of suitable thermoplastic polymers include polyethylene homopolymers, such as low density polyethylene (LDPE) and high density polyethylene (HDPE), and polyethylene copolymers such as, e.g., ionomers, EVA, EMA, heterogeneous (Zeigler-Natta catalyzed) ethylene/alpha-olefin copolymers, and homogeneous (metallocene, single-cite catalyzed) ethylene/alpha-olefin copolymers. Ethylene/alpha-olefin copolymers are copolymers of ethylene with one or more comonomers selected from $C_3$ to $C_{20}$ alpha-olefins, such as 1-butene, 1-pentene, 1-hexene, 1-octene, methyl pentene and the like, in which the polymer molecules comprise long chains with relatively few side chain branches, including linear low density polyethylene (LLDPE), linear medium density polyethylene (LMDPE), very low density polyethylene (VLDPE), and ultra-low density polyethylene (ULDPE). Various other materials are also suitable such as, e.g., polypropylene homopolymer or polypropylene copolymer (e.g., propylene/ethylene copolymer), polyesters, polystyrenes, polyamides, polycarbonates, etc. The film may be monolayer or multilayer and can be made by any known coextrusion process by melting the component polymer(s) and extruding or coextruding them through one or more flat or annular dies.

Figure 3A:
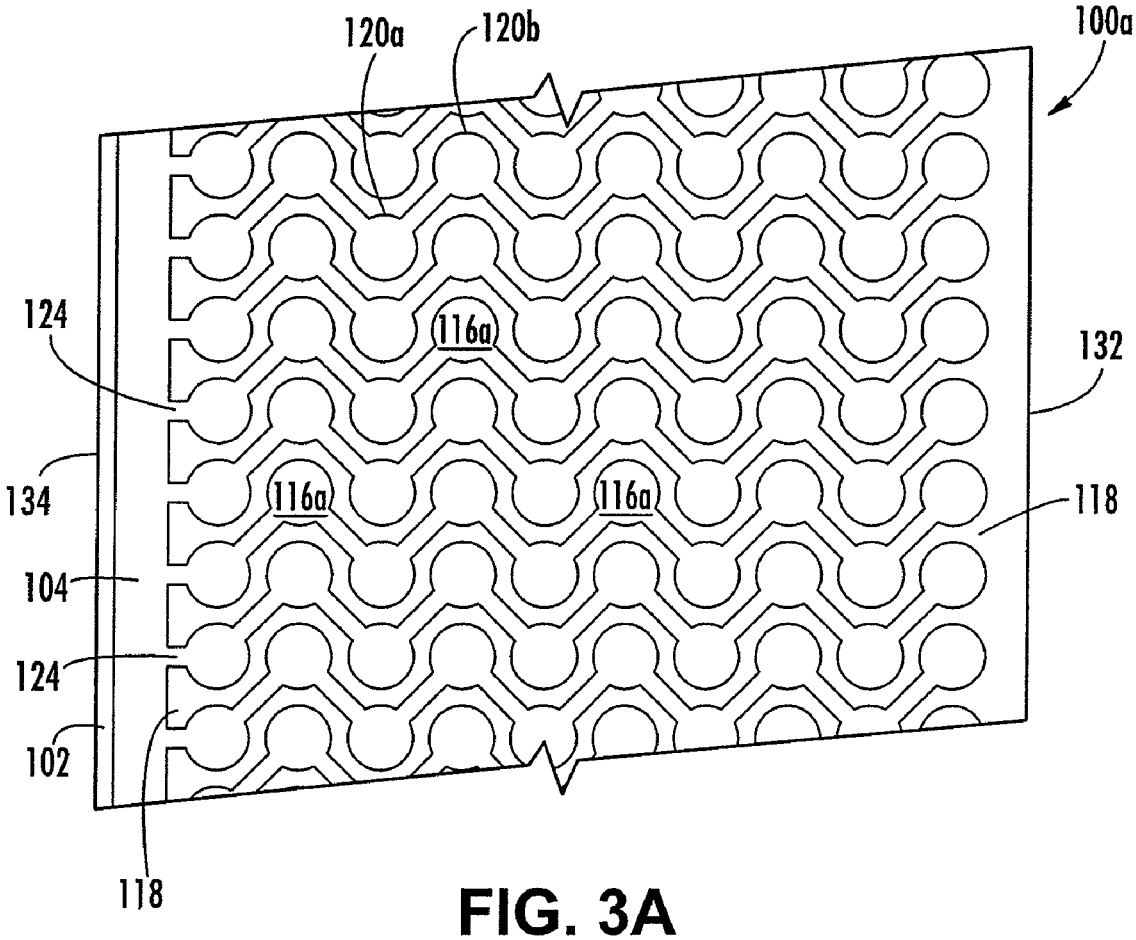
FIGS. 3A through 3D are graphical illustrations of various embodiments of inflatable liners having seal patterns of varying designs.
Figure 3B:
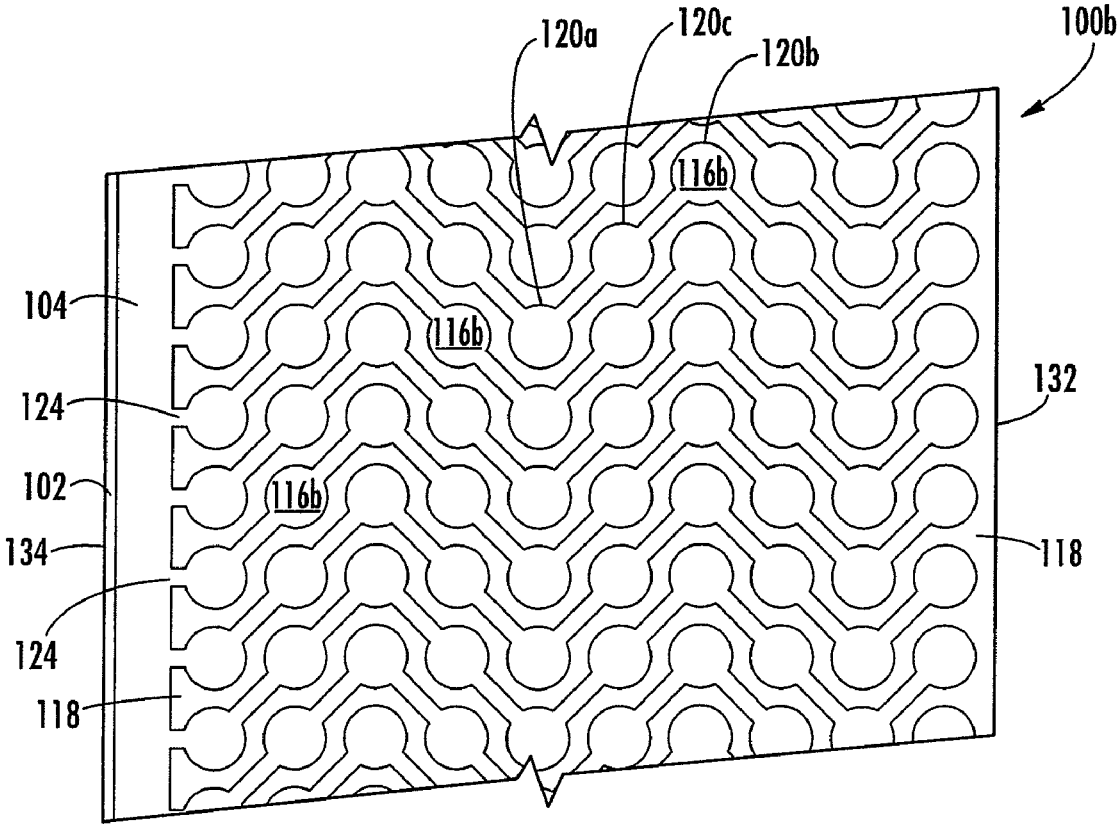
Figure 3C:
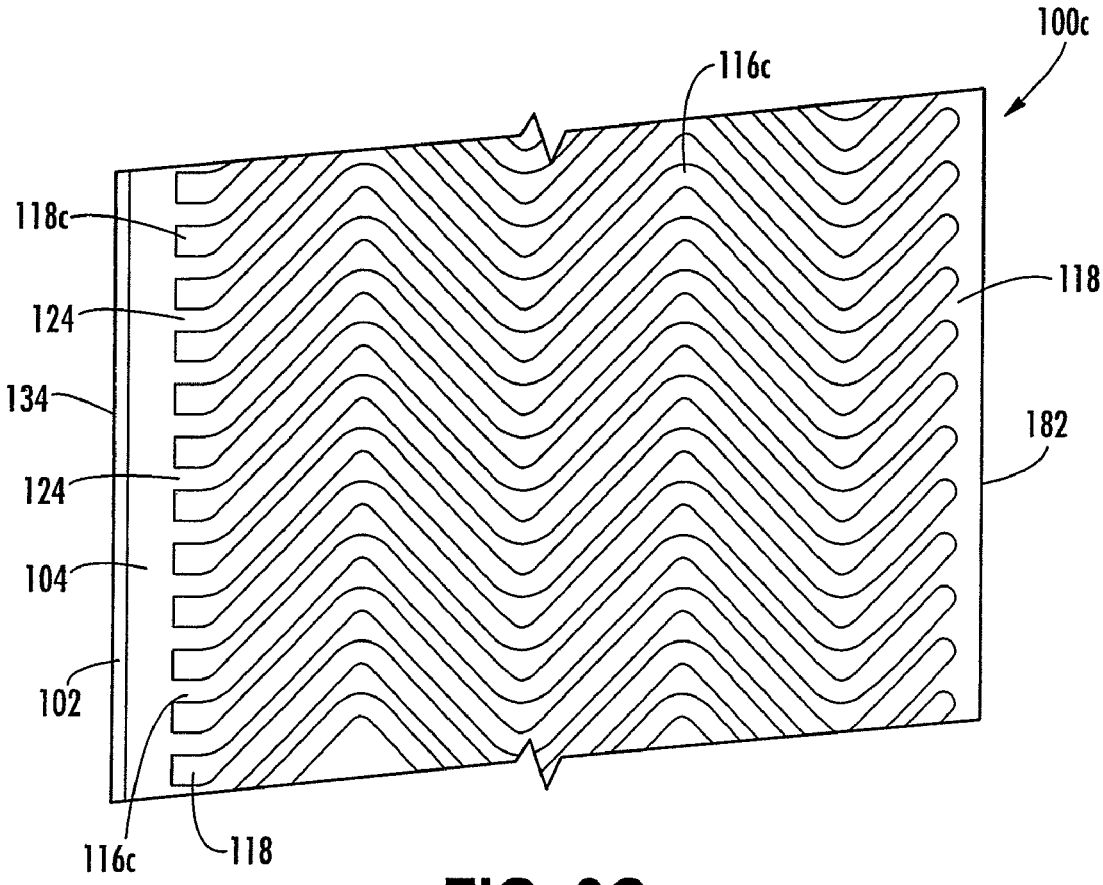
Figure 3D:
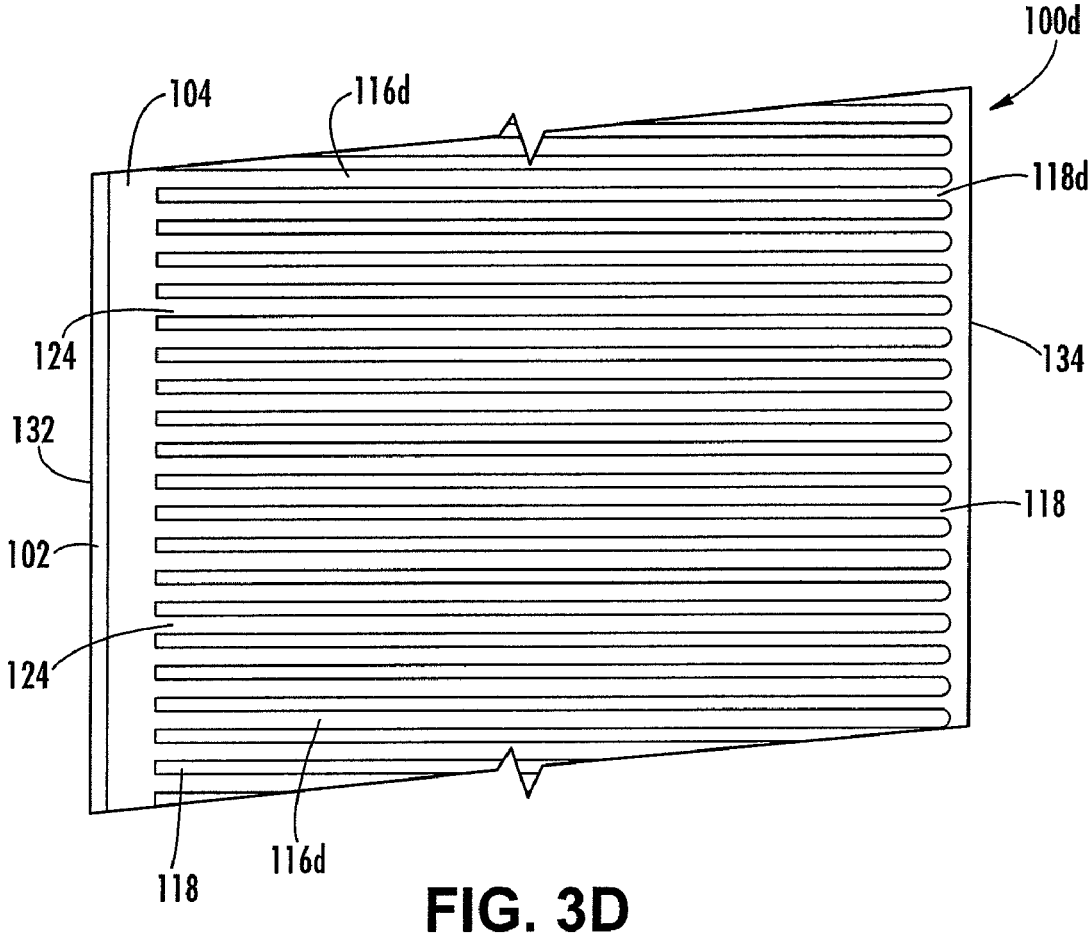

As shown in FIG. 2A, the inflatable channels 116 can be formed between sheets 112, 114 in a manner wherein the channels extend longitudinally across the inflatable web in a linear orientation that is substantially parallel to the edges 106*a*, 108*a*. The semi-spherical bubbles 120 in each successive inflatable chamber 116 may be off-set. As a result, the amount of bubbles present in each successive chamber can be increased to provide additional protection. In alternative embodiments, the inflatable channels may extend longitudinally across the length of the inflatable web in an orientation wherein the channels oscillate or are staggered. In this regard, FIGS. 3A and 3B depict inflatable webs 100*a*, 100*b*, respectively, having non-linear inflatable channels 116*a* that oscillate with respect to edges 106*a*, 108*a*. At the apex and valley of each oscillation a semi-spherical bubble 120*a*, 120*b* is present. In FIG. 3B an intermediate semi-spherical bubble 120*c* is disposed between bubbles 120*a* and 120*b*. The advantage of this geometric arrangement of chambers is that it provides more complete protection in the event an inflatable chamber is ruptured or deflated. In another alternative embodiment illustrated in FIGS. 3C and 3D, the inflatable webs 100*c*, 100*d* may comprise successive inflatable channels 116*c*, 116*d*, respectively, having no change in width along their length. In this embodiment, the inflatable chambers 116*c*, 116*d* are narrower and closer together. In the event any one channel becomes deflated, the amount of unprotected space is relatively small in comparison to inflatable channel 116 of FIG. 2A. FIG. 3C illustrates that the inflatable chambers 116*c* can also be non-linear to provide even more protection.

The inflatable liner is placed within the pouch in a partially inflated state. The term "partially" as used herein means that the inflatable liner comprises a controlled volume of gas that is sufficient to fill the common channel when all of the gas is moved out of the inflatable chambers and into the common channel. The overall thickness of the inflatable mailer in this partially inflated state is typically about 1/64 to 1/2 inch thick, with a thickness of about 1/16 inch being somewhat preferred. As a result, the storage and shipment of the inflatable mailer may be more efficient and cost effective than the conventional methods that are discussed above.

Figure 4A:
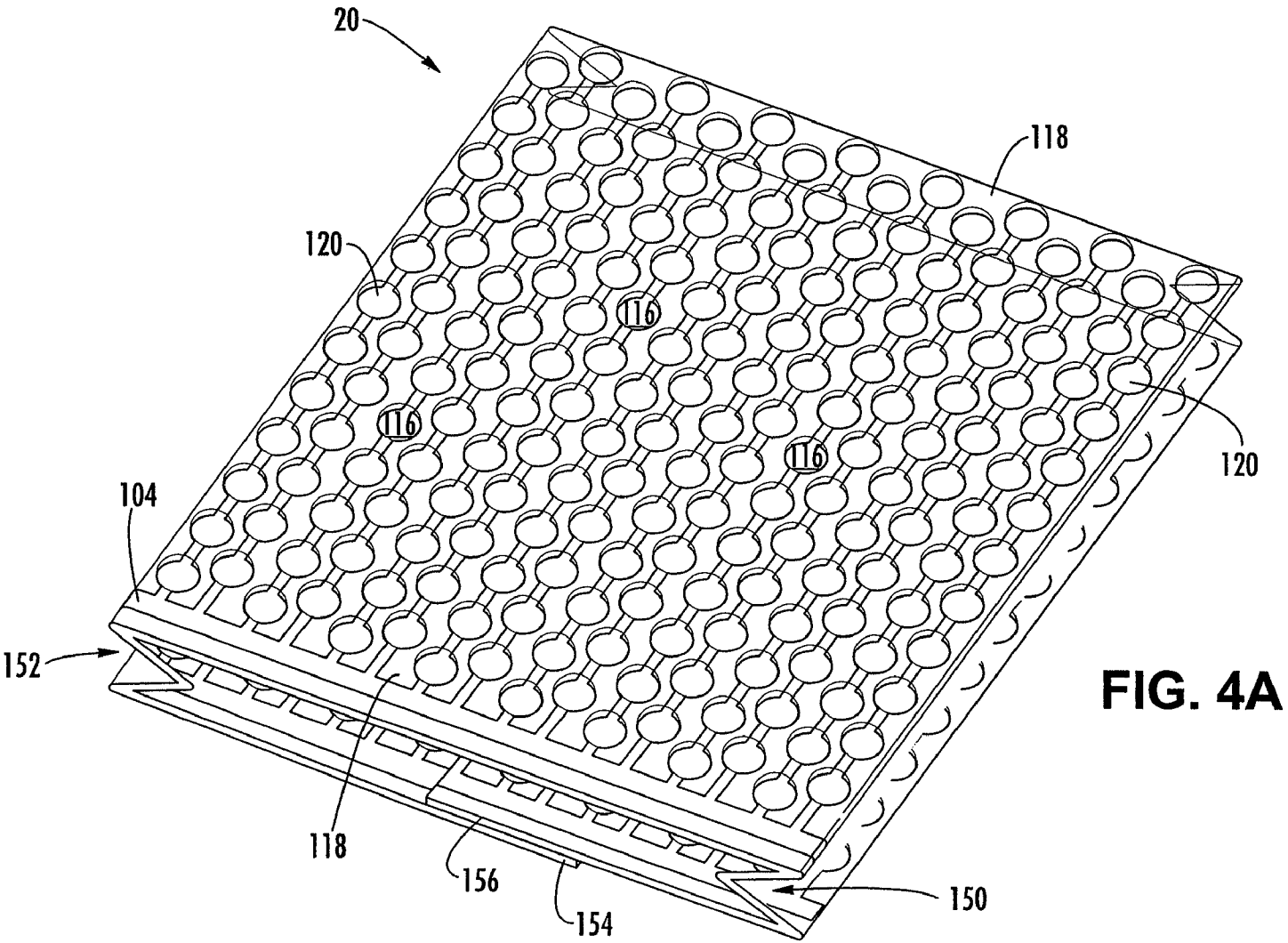
FIGS. 4A and 4B are graphical illustrations representing two different methods that can be used to fold an inflatable liner before insertion into a pouch.
Figure 4B:
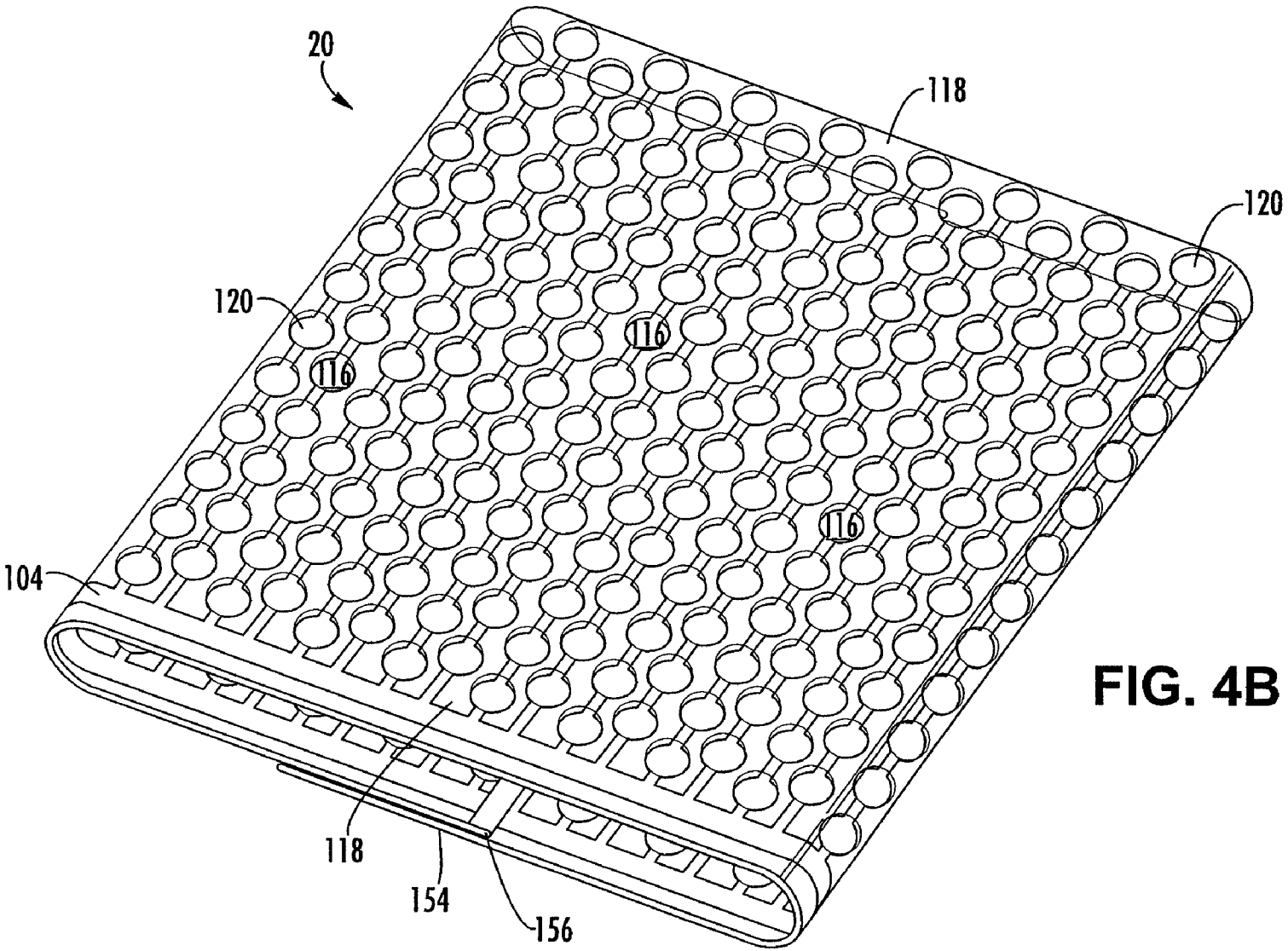

Preferably, the liner is positioned in the pouch so that the common channel is disposed adjacent to the bottom edge of the pouch, although this can be varied depending upon the orientation of the mailer in relation to the device that is used to inflate the liner. To provide protection on all sides of an article, the inflatable liner is typically folded over so that it covers the interior perimeter of the pouch. Typically, the thickness of the liner increases as it is inflated resulting in a decrease in the width and length of the liner. To compensate for this decrease, the length of the inflatable liner placed in the interior of the pouch is typically greater than the internal perimeter of the pouch. In this regard, FIGS. 4A and 4B illustrate two folding methods that can be used to position the liner within the pouch. In FIG. 4A, the inflatable liner 20 includes two z-shaped folds 150, 152. The z-fold allows the width of the folded liner to fit the interior perimeter of the pouch while allowing the length of the inflatable liner to be longer than the internal perimeter of the pouch. Similarly, FIG. 4B shows an alternative method of folding the liner wherein one edge 154 of the liner extends below and beyond the opposing edge 156. Both folding methods provide a means by which the liner will correctly fit the interior dimensions of the pouch after inflation. To compensate for the reduction in width, the inflatable liner may also have a width that is greater than the depth of the pouch. In this regard, FIG. 1 illustrates an inflatable mailer 10 wherein a portion 24 of the inflatable liner 20 extends beyond the opening 40 of the pouch 12. After inflation, the width of the liner is reduced so that the exposed edge is adjacent to the opening (see FIG. 1B).

The dimensions of the inflatable mailer may be varied depending upon its intended use. For instance, mailers for shipping larger objects will of course require a larger size pouch than mailers adapted for shipping smaller objects. Similarly, the thickness and impact absorbing capability of the liner can be increased or decreased by varying the volume of gas present in the liner. The volume of air in the liner can be controlled by changing the volume of the inflatable chambers during the manufacturing process, or by increasing or decreasing the amount of gas introduced into the chambers. Typically, the thickness of the inflated liner is in the range from about 0.5 to 3 inches, with a thickness from about 1 to 2 inches being somewhat more typical.

The inflatable mailers are typically transported in a relatively flat and compact state. As a result, the inflatable mailers occupy less space, which may result in lower shipping costs and a reduction in the amount of space that is need for storage. Typically, the inflatable mailer is inflated at the point of use, such as a packaging station. The mailers are inflated with an apparatus that moves the gas disposed in the liner into the common channel, introduces gas into the channel, and then seals the liner so that the gas is confined within the now filled inflatable chambers. The apparatus for inflating the inflatable mailer typically comprises a conveying mechanism for conveying the inflatable mailer along a longitudinal path; a nip disposed along the path that is adapted to move the gas within the liner into the common channel to thereby create the inflation pathway; a gas inflation nozzle having one or more inflation needles that are adapted to pierce the common channel and introduce gas into the liner; and a sealing device that is adapted to seal the inflated liner so that no gas escapes from within the liner.

Figure 5:
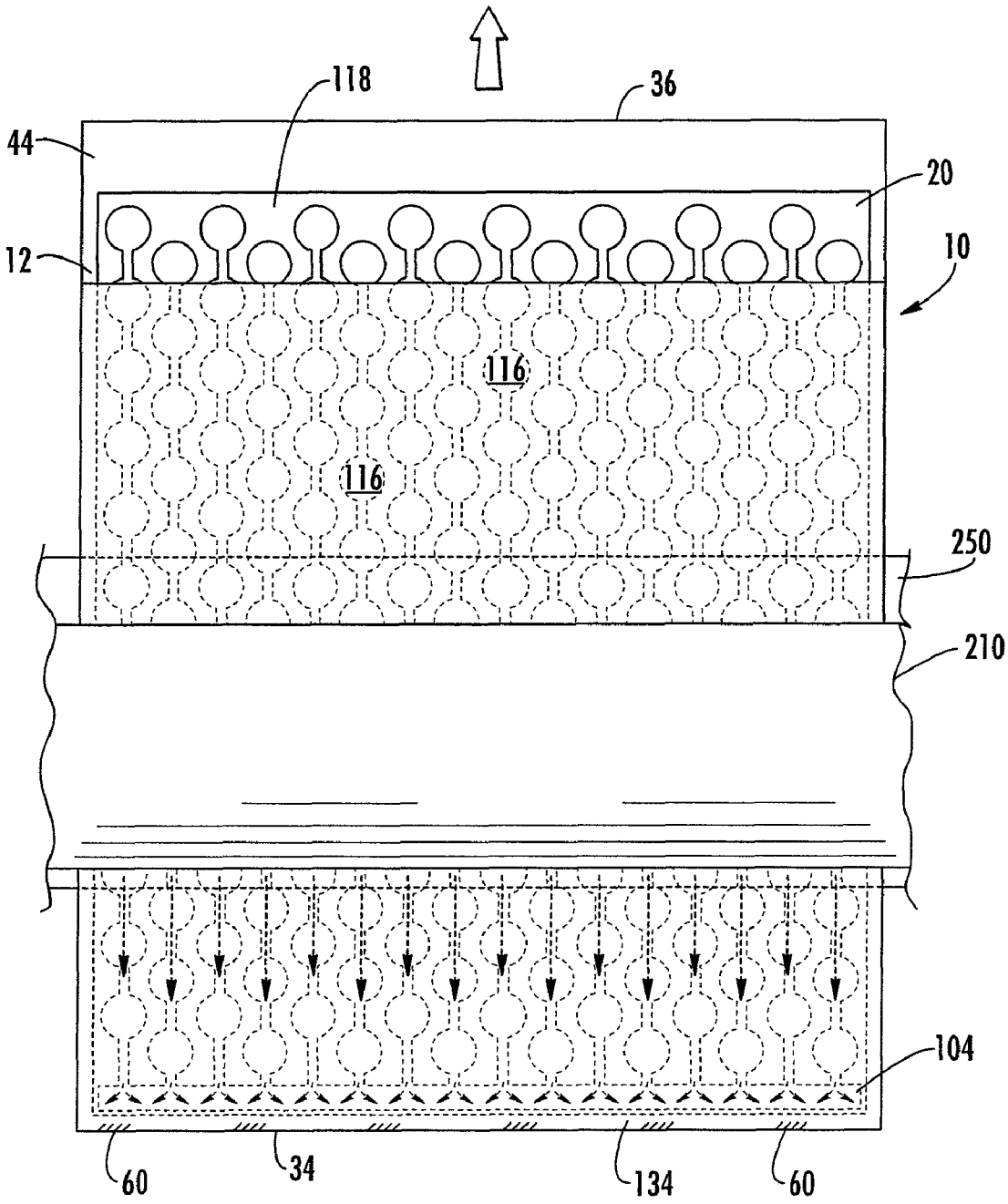
FIG. 5 is a graphical illustration of the inflatable mailer passing through a nip viewed along line 5-5 of FIG. 8D.

With reference to FIG. 5, an inflatable mailer 10 is illustrated in the process of traveling between two rolls 210, 250. FIG. 5 is a front view of rolls 210, 250 viewed along line 5-5 of FIG. 8D. Rolls 210, 250 are typically clamped together with sufficient force define a nip therebetween. Preferably, the inflatable mailer is disposed between the rolls so that the common channel 104 is the last portion of the liner 20 to pass between the rolls. As the mailer 10 passes between the rolls, the nipping action of rolls 210, 250 moves the controlled volume of gas within the liner through the inflatable chambers 116 in the direction of the common channel 104. Movement of the gas through the chambers is represented by the small dashed arrows. The gas entering the common channel causes it to expand and inflate. In some embodiments, the pouch 12 may also include one or more vent openings 60 that allow air trapped in the pouch to escape.

Figure 6A:
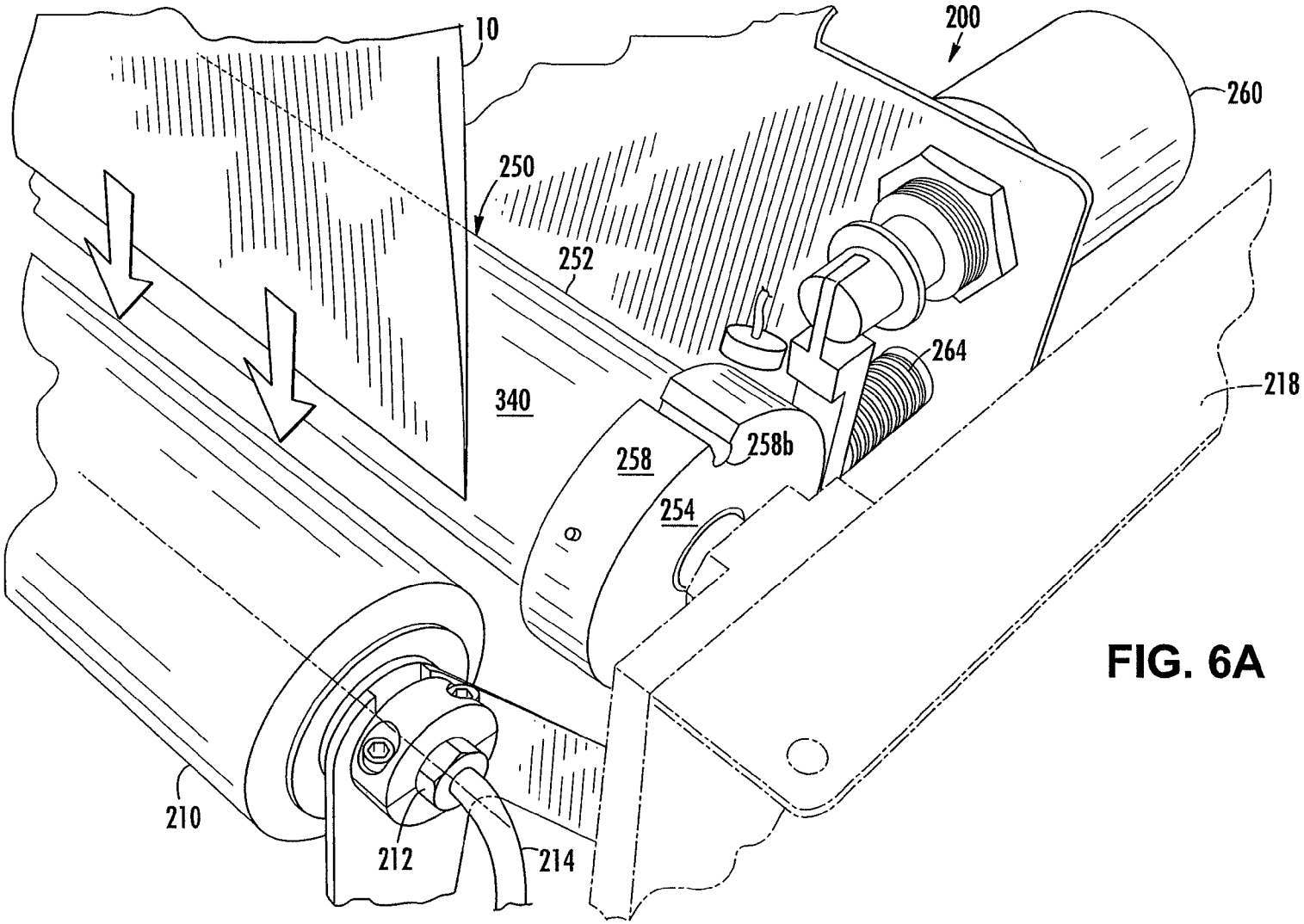
FIG. 6A is a perspective view of an inflation device that is ready for receiving an inflatable mailer.
Figure 6B:
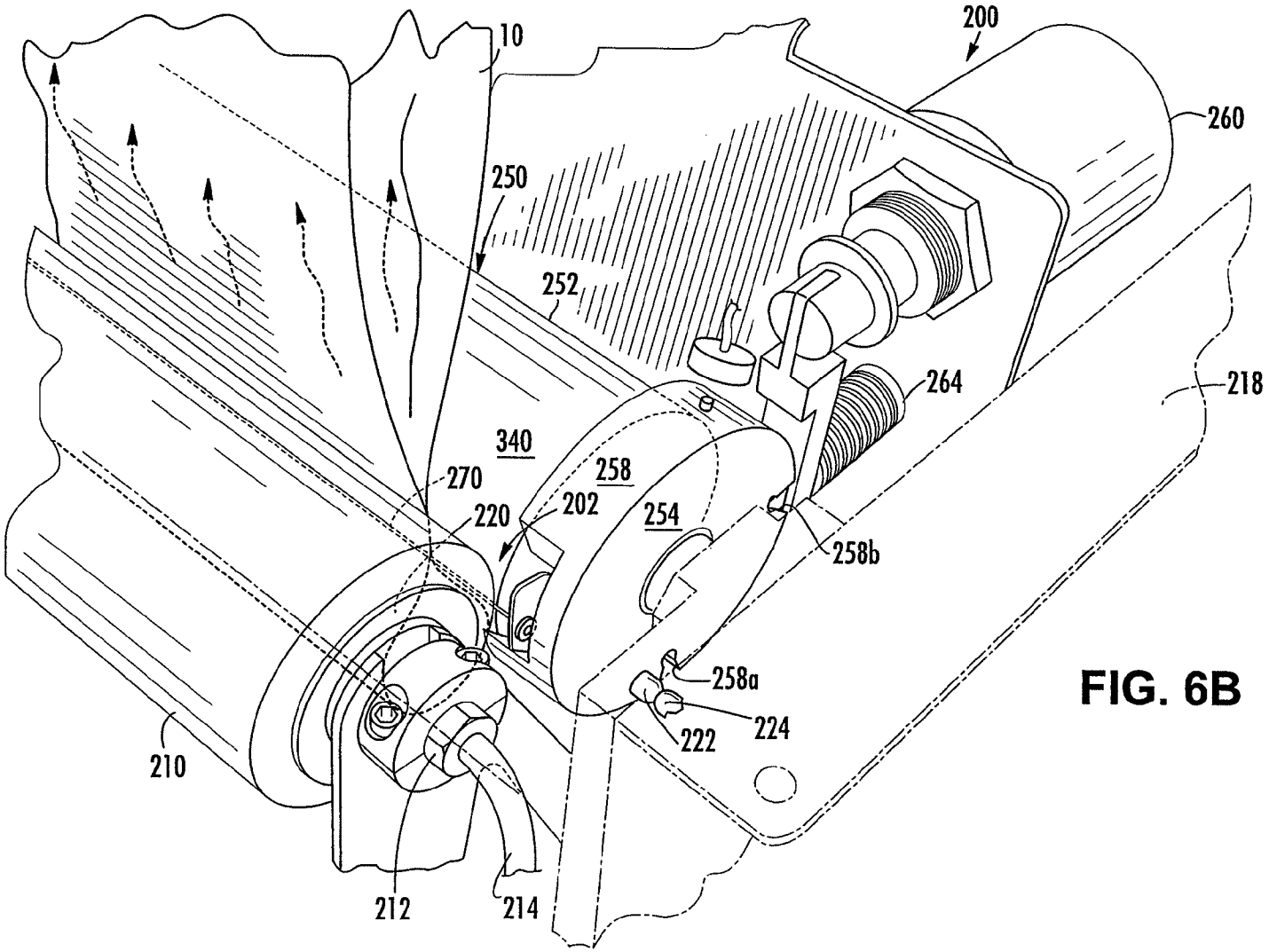
FIG. 6B is a perspective view of the inflation device of FIG. 6A illustrating an inflatable mailer in the process of being inflated.

With reference to FIGS. 6A and 6B, one embodiment of an apparatus for inflating the inflatable mailer is illustrated and broadly designated as reference number 200. Apparatus 200 is also referred to as an "inflation device." FIG. 6A illustrates an inflatable mailer being inserted into the inflation device between two rolls that define a nip therebetween. In FIG. 6B, the inflation device 200 is depicted as being in the process of inflating the inflatable mailer 10. The embodiment illustrated in FIGS. 6A and 6B comprises a drive roll 210 and a driven roll 250 that together form a conveyance mechanism to drive the inflatable mailer in the forward direction. Drive roll 210 and driven roll 250 also cooperate together to form a nip therebetween at 202. The nip 202 is typically the point at which drive roll 210 and driven roll 250 are tangent to each other. The inflation device 200 may also include a frame housing 218 for supporting the drive roll 210 and the driven roll 250.

In FIG. 6A the inflatable mailer is in the process of being inserted into the inflation device. The drive roll 210 is moveable between an open position (FIG. 6A) and a closed position (FIG. 6B). Typically, the inflatable mailer is inserted into the inflation device when drive roll 210 is in the open position. The inflatable mailer may be loaded into the inflation device by placing it into a receptacle (not shown) that is adapted to slidingly receive the inflatable mailer. In the illustrated embodiment, the opening of the receptacle is typically disposed below rolls 210, 250. Preferably, the opening of the receptacle is vertically aligned with nip 202. In some embodiments, the conveying mechanism may comprise an inclined or vertical surface that feeds the inflatable mailer between the drive roll 210 and the driven roll 250.

After the mailer is inserted into the receptacle, the drive roll is moved into the closed position. The drive roll 210 typically is a powered roll and may include an internal motor 212 and an associated power cord 214. While in the closed position, the drive roll 210 may be in rotational contact with the driven roll 250. As a result, rotation of the drive roll also rotates the driven roll. Once the drive roll is in a closed position, power is supplied to the drive roll via a motor. Drive roll and driven roll cooperate together to grip and drive the inflatable mailer through nip 202. As discussed above, the nipping action causes the controlled volume of gas disposed within the liner to move in the direction of the common channel (See FIG. 5). Travel of the mailer between the rolls causes the volume of gas to inflate the common channel and produce a "pre-bubble" in the mailer. The pre-bubble 220 is represented in FIG. 6B by the dashed lines that form a tear-shaped structure in the mailer. As shown, the pre-bubble comprises an expanded portion of the mailer. Typically, forward travel of the inflatable mailer is stopped after the pre-bubble is formed. Preferably, travel of the inflatable mailer is stopped when the pre-bubble is disposed in close proximity to nip 202. The inflatable mailer is now in position for inflation.

One or more inflation nozzles (not shown) pierce the pre-bubble and begin introducing gas into the liner. The inflation nozzle typically comprises an inflation needle, similar to a hypodermic needle, that is capable of being in fluid communication with a gas source, such as an air compressor. Once inflation begins, the drive roll 210 may be moved into the open position to help facilitate inflation of the liner. The drive roll is typically returned to the closed position after the mailer has been inflated to a desired level. In the closed position, the clamping force of the drive roll helps facilitate heat sealing of the inflatable liner. A sealing device 270 seals the inflated mailer to prevent the escape of gas. In the embodiment illustrated in FIG. 6B, the sealing device comprises a resistive wire that extends laterally across the driven roll. Preferably, the sealing device 270 is disposed between drive roll 210 and driven roll 250 at the point where the lateral surfaces of the rolls are tangent to each other (i.e. nip 202). The now inflated and sealed mailer is ready for immediate use. An operator may then place an article into the inflated mailer and prepare the mailer for shipping.

As discussed above, the drive roll 210 typically is a powered roll and may include an internal motor 212 and an associated power cord 214. The drive roll may be powered using other methods including, but not limited to, an external motor that is in mechanical communication with the drive roll via a suitable mechanism such as a belt and pulley or chain and sprocket, or equivalent mechanism. The drive roll 210 may comprise aluminum, steel, or any other suitable material. Typically, the outer surface of the drive roll is covered with a resilient material such as silicone, rubber, and the like that is capable of gripping and driving the mailer forward without damaging the mailer. Typically, the thickness of the outer surface covering 340 is from about ⅛ to ½ an inch thick, with a thickness of about ¼ of an inch being somewhat more typical.

In the embodiment illustrated in FIGS. 6A and 6B, the driven roll 250 comprises a generally elongated cylindrical roll having a tubular roll 252 rotatably disposed about a central shaft (not shown). In the closed position the drive roll 210 is adapted for nippingly engaging the tubular roll 252 portion of the driven roll 250. The drive roll 210 cooperates with the driven roll 250 to drive the mailer forward and to create a pre-bubble within the mailer as it passes between the two rolls 210, 250. Rotation of drive roll 210 in the forward direction applies rotational pressure to the tubular roll 252, resulting in the forward rotation of the tubular roll. It should be recognized that in some embodiments, the driven roll 250 may also comprise an internal motor for driving the driven roll in a desired direction.

The surface 340 of the driven roll 250 typically comprises a material that grips and drives the mailer forward without fracturing or tearing the mailer. The material should also be heat resistant so that it is able to withstand the temperatures produced by the sealing device. Typically, the outer surface 340 should be able to withstand temperatures exceeding 250° F. Suitable materials include, without limitation, rubber, silicone polymeric plastics, cork, steel, stainless steel, metallic alloys, and the like. It should be recognized that a variety of different materials can be used for the surface of the tubular roll provided that the material can withstand temperatures in excess of 250° F. and can grip and drive the mailer forward without causing damage to the mailer. The tubular roll may comprise aluminum, stainless steel, or any other suitable material.

The tubular roll is disposed between a proximal hub 254 and a distal hub (not shown). The tubular roll 252 and the hubs are disposed about the central shaft. The central shaft is rotatably disposed and supported by the frame housing 218. The proximal and distal hubs are rotatably fixed to the central shaft so rotation of the hubs also rotates the central shaft. Friction members (see FIG. 7, reference number 342) are disposed between each hub 254 and the tubular roll 252. The friction members cause the hubs to rotate with the driven roll 250 unless one or both hubs are held in place, in which case, the driven roll 250 will continue to rotate about the central shaft.

In one embodiment, one of the hubs includes an indexing mechanism that is adapted to position the resistive wire between the drive roll and the driven roll at the nip 202, also referred to as the "sealing position." Preferably, the positioning of the resistive wire in the sealing position coincides with positioning the inflatable mailer between rolls 210, 250 in the correct orientation for inflation and sealing position. For example, the resistive wire may extend transversely across the inflation conduits (see FIG. 2A, reference number 124). As a result, the individual inflation conduits can be sealed so that each includes a seal that separates it from the other inflation conduits.

Here, the indexing mechanism is illustrated as being incorporated into the proximal hub 254, also referred to as the "indexing hub." It should be recognized however that the indexing mechanism can be disposed on either hub. The indexing hub includes a pair of recesses 258*a*, 258*b* that are adapted to releasably engage a plunger (not visible). The plunger engages one of the recesses and prevents rotation of the indexing hub with driven roll 250. Preventing the rotation of the indexing hub also prevents rotation of the opposing hub because both hubs are rotatably fixed to the central shaft.

The plunger may be activated by an electric solenoid 260 that momentarily retracts the plunger from the recess. Activation of the solenoid may be operated by a controller or sensor. Retraction of the plunger causes the hubs and tubular roll 252 to rotate in unison. The plunger is under tension via a spring 264 or other suitable means so that after it has been retracted from the recess it rides along the circumferential surface 258 of the hub 254 until it engages the second recess 258*b*. Preferably, the position of resistive wire 270 with respect to recess 258*b* is such that when the plunger engages the second recess 258*b*, the resistive wire extends laterally across the surface of roll 250 at the point where the drive roll and the driven roll are tangent to each other. As a result, it is possible to use the indexing mechanism to accurately position the resistive wire for sealing the inflatable mailer at a desired location.

Figures 7, 7A, 7B:
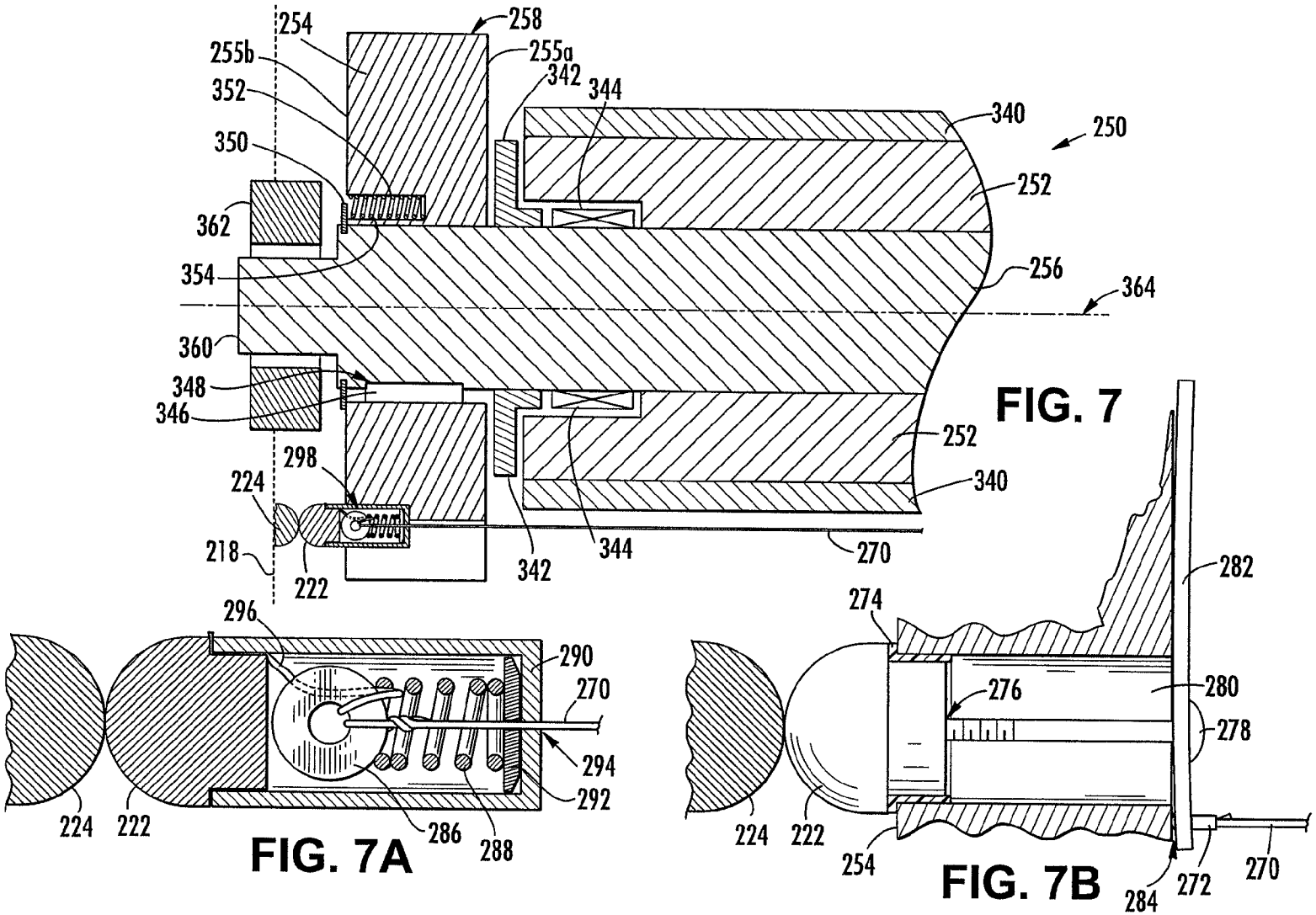
FIG. 7 is a cross-sectional view of a driven roll that is used in conjunction with a drive roll to move gas through the inflatable liner and into the common channel.
FIGS. 7A and 7B are graphical illustrations of a resistive wire that is adapted for providing tension to the driven roll.

With reference to FIG. 7, a cross-sectional portion of the driven roll 250 is illustrated. FIG. 7 depicts the proximal portion of the driven roll and hub with the indexing mechanism not illustrated for the sake of clarity. Typically, the distal portion of the driven roll is identical to the proximal end. It should be recognized that the distal portion of the driven roll may differ from the proximal portion for various reasons including, but not limited to, inclusion of various sensor devices, sealing devices, and general changes made to improve or adapt the inflation device to differing manufacturing processes or environments.

As shown in FIG. 7, the driven roll 250 includes a tubular roll 252 that is rotatably disposed about a central shaft 256 via one or more bearings 344. The proximal end 360 of central shaft 256 is rotatably secured to the frame 218 of the inflation device. A friction reducing member 362, such as a bearing, is disposed between the proximal end 360 of the shaft 256 and the frame. The friction reducing member allows the central shaft to rotate about its longitudinal axis 364. Suitable friction reducing members include bearings such as an idler bearing. The bearings can be comprised of a wide variety of materials including, but not limited to stainless steel, ceramic, aluminum, plastic, metallic alloys such as bronze, and the like. It should be recognized that other methods such as packed grease, for example, could be used to facilitate rotation of the central shaft, although not necessarily with equivalent results.

The proximal end 360 of the central shaft is adapted to slidingly receive the hub 254 thereon. The hub includes a central channel through which the shaft may be inserted. Preferably, the hub has some degree of freedom to move in the transverse direction along the shaft. Typically, the hub and shaft include a key 346 and keyway 348 which rotably fix the hub and shaft together. The hub and shaft can be keyed (see 346 and 348) so that rotation of the hub is fixed relative to the shaft. FIG. 7 illustrates that the central shaft 256 can be transversely slotted for receipt of a key 346. A corresponding slot for fixedly receiving the key is present in central channel of the hub through which the central shaft 256 can be inserted. As a result, rotation of the central shaft also rotates the hub, and vice versa. It should be recognized the type of key used and its placement could be varied depending upon the designer's particular preference, and that other methods including a spline, d-shaped or square shaft and a correspondingly shaped hub bore may be used to rotatably fix the hubs to the shaft provided that the hub remains free to move transversely along the shaft.

One or more friction members 342 are disposed about the central shaft 256 between the hub 254 and tubular roll 252. As discussed above, the frictional members are adapted to grip the tubular member 252 and the inner surface 255*a* of the hubs so that rotation of the driven roll 250 will also result in rotating the hubs. The friction members comprise a material that provides enough friction to rotate the hubs when the driven roller is rotated, but not so much friction that the driven roll is prevented from rotating when rotation of the hubs is prevented. For instance, if the indexing system (see FIG. 6B) is engaged so that the hub is prevented from rotation, the driven roll 250 is adapted to overcome the friction and rotate about the central shaft. In some embodiments, the friction members comprise a plastic material such as nylon, acetal, and the like. It should be recognized that the friction members may comprise a wide variety of materials provided that the frictional properties of the material meets the functional requirements discussed above.

In some embodiments, the hubs include electrical contacts 222 that are adapted to be in electrical communication with the resistive wire 270. The electrical contacts may comprise a switch, lead, cap, wiper, brush, or equivalent mechanism that can be used to produce an electrical pathway through the resistive wire. Each electrical contact 222 is adapted to electrically contact a second contact 224 that may be disposed on the frame 218 or other structure. Contacts 222, 224 provide a current pathway through which electrical current may be passed through the resistive wire. Preferably, the location of contacts 222, 224 on the hub and frame, respectively, is such that when the resistive wire is moved into a sealing position, contacts 222, 224 come into contact with each other to thereby produce an electrical connection. In some embodiments, electrical current is not supplied to contact 224 until after the liner has been inflated to a desired level.

Electrical contacts 222, 224 typically comprise an electrically conductive material such as brass, copper, and the like. In a preferred embodiment, electrical contact 224 is disposed within a recess or opening in the frame 218 and comprises a switch that is adapted to move between an extended position and a retracted position. In the retracted position, contact 224 is capable of supplying current to contact 222. As the indexing hub is rotated, contact 222 comes into abutting contact with contact 224. Continued rotation of the hub causes contact 222 to move contact 224 inwardly in the direction of the frame 218, until contact 224 is moved into the retracted position. Preferably, contact 224 is in the retracted position at the same time that the resistive wire is in the sealing position. At a desired time, the controller may then direct electrical current to pass through contact 224 and into contact 222.

Retaining ring 350 or other clamping devices may be used to positionally secure the hubs to the shaft. Preferably, the clamping device presses the hubs inwardly in the direction of the driven roll 250 so that frictional pressure is maintained between the hubs and the driven roll. In some embodiments, a compression spring 354 disposed within the hub helps to maintain frictional pressure. As shown in FIG. 7, the compression spring 354 is disposed in a recess 352, such as a counter bore, tapped hole, threaded hole, or the like, that extends laterally from the outer surface 255*b* through at least a portion of the hub. The spring 354 applies force to the retaining ring 350 and the hub so that hub is slid inwardly along the shaft and presses against the friction member and the driven roll. Preferably, the inflation devices includes at least two compression springs that are disposed about 180 degrees opposed on the hub to balance the force. Typically, each compression spring has a spring force that is from about 5 to 10 lbs.

In some embodiments, a compression spring and resistive wire 270 are used in combination to provide the force that maintains the frictional pressure between the hubs and the driven roll. In this regard, FIG. 7 illustrates a compression spring 354 that is disposed about 180° opposite the resistive wire. FIGS. 7A and 7B illustrate two exemplary methods of maintaining frictional pressure between the hubs and driven roll 250. In FIG. 7A, a wire assembly is illustrated in which both ends of the resistive wire 270 are each attached to a spring 288 disposed in an end housing 290 within the hub. The end housing 290 typically comprises a non-conductive material, such as plastic, so that the spring and wire can be electrically insulated from the hub. The end housing is disposed in a recess 298, such as a counter bore, that extends at least partially through the hub. The resistive wire 270 is attached to a conductive fitting such as a washer 286. The end housing 290 may also include a center bushing 292 that is capable of withstanding the heat produced by the resistive wire. The resistive wire passes through a channel 294 formed in the end housing. Preferably, the channel 294 is a few thousandths of an inch larger than the resistive wire to help keep the wire centered and stable. Typically, the washer 286 has a larger diameter than the spring 288 so that when the wire assembly is stretched into position, the spring is compressed, thereby tensioning the resistive wire and compressing the friction members as previously discussed. The spring also allows for expansion and contraction of the resistive wire during the sealing process. In some embodiments, a current supply wire 296 is also attached to the washer. One end of the supply wire 296 may be placed between the contact 222 and the end housing 290 during assembly so that pressing the contact 222 into the housing 290 creates an electrical connection between the supply wire and the contact 222.

In an alternative embodiment illustrated in FIG. 7B, both ends of the resistive wire are attached to leaf springs disposed on the inner surface 255*a* of each hub. The leaf spring maintains the resistive wires under tension so that the desired level of frictional pressure is maintained. In this embodiment, the hub includes a channel 280 that extends laterally through the hub. The electrical contact 222 is disposed on the outer surface of the hub and extends at least partially into the channel 280. A non-conductive sleeve 274 may be disposed between the hub and the contact to electrically isolate the contact 222 from the hub. The leaf spring 282 is attached to the electrical contact via a screw 278 or similar fitting that extends from the leaf spring through the channel and is fitted into the contact at 276. The resistive wire 270 is attached to the leaf spring via a crimp 272 or similar fitting. A non-conductive material, such as a plastic bushing (not shown) may be disposed between the leaf spring and the hub at 284. The non-conductive material electrically isolates the leaf spring from the hub.

With reference to FIGS. 8A through 8K, a process of inflating an inflatable mailer using inflation device 200 is illustrated in a step-wise manner. FIGS. 8A through 8K depict a schematic side view of the proximal portion of the inflation device. The distal portion of the inflation device typically has substantially the same structure.

Figure 8A:
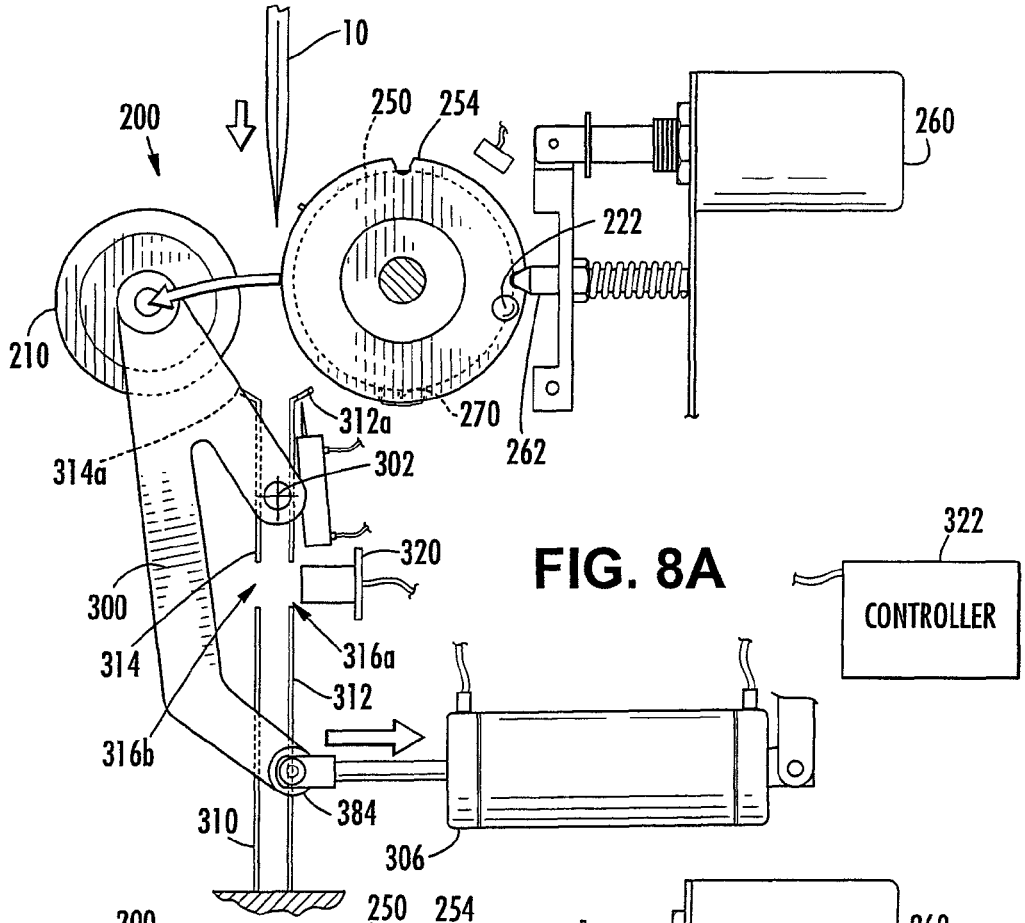
FIGS. 8A through 8K are schematic side illustrations depicting in a step-wise manner the process of inflating an inflatable mailer using the apparatus depicted in FIG. 6A.
Figure 8B:
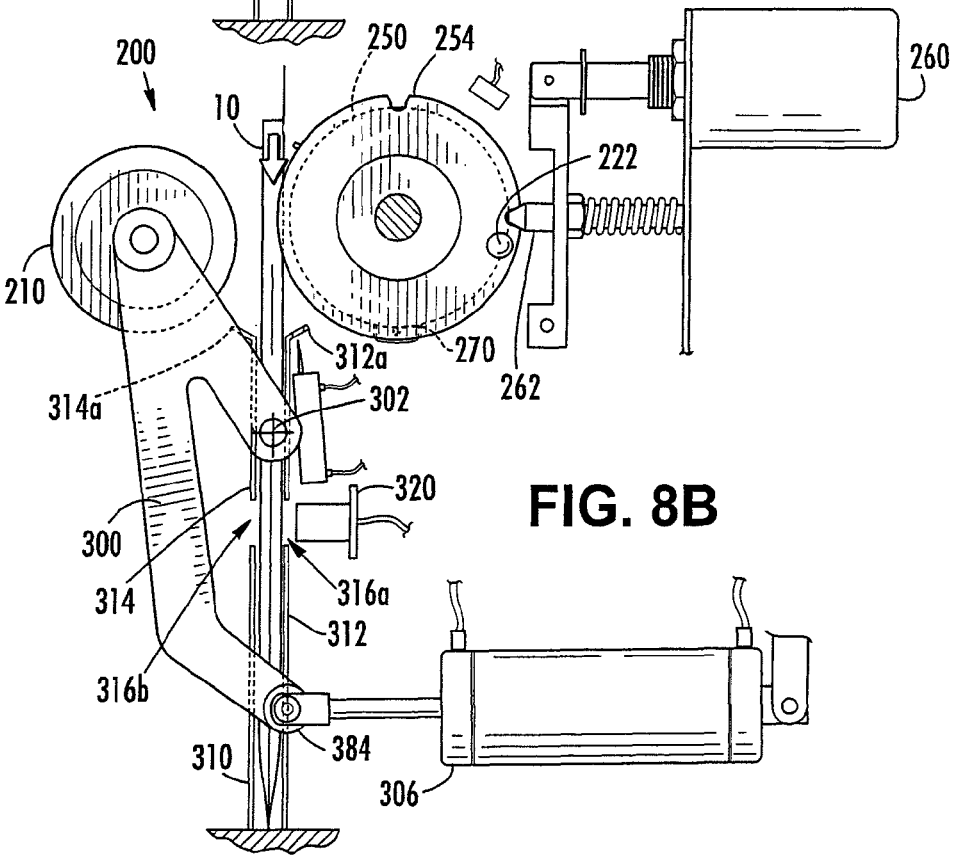

FIGS. 8A and 8B illustrate an inflatable mailer being inserted into position to begin the inflation process. In FIG. 8A, the drive roll 210 is moved into an open position. The inflatable mailer 10 is then dropped between drive roll 210 and the driven roll 250 and into a receptacle 310 that is adapted to slidingly receive the inflatable mailer 10. Indexing hub 254 is oriented so that the resistive wire 270 is not in the sealing position, also referred to as the "nominal position." While in the nominal position, plunger 262 is engaged in the first recess 258*a* so that rotation of the hubs is prevented.

As shown, the drive roll 210 is supported by a carriage assembly 300 that is in mechanical communication with one or more pistons 306 at 384. Extending and retracting piston 306 moves the drive roll between the closed position and open position. The piston may comprise pneumatic cylinder, electric solenoid, or other suitable means that is sufficient to produce the desired nipping force that is necessary to move the controlled volume of gas into the common channel. The carriage assembly 300 also includes a pivot point 302 wherein the assembly is mounted to the frame housing (not shown). Preferably, the horizontal position of the pivot point is disposed on a tangent line that extends between the drive roll and the driven roll. This will help maintain the relative motion between each roll as the drive roll is moved between the open and closed positions. The vertical position of the pivot point 302 may be varied to maximize the mechanical advantage that is necessary to form the nip. Typically, the amount of clamping force is greater than about 40 lbs, with a clamping force in excess of 300 lbs being somewhat more preferred. It should be recognized that other methods may be employed to move the drive roll between the open and closed positions.

As discussed above, the inflation device may include a receptacle 310 that is adapted for receiving and presenting an inflatable mailer. In some embodiments, the receptacle 310 may be disposed below between the drive roll 210 and the driven roll. The receptacle 310 typically comprises sidewalls 312, 314 for supporting the mailer in proper alignment between the drive roll and the driven roll. The receptacle may also include flares 312*a*, 314*a* that are disposed at upper edge of the receptacle adjacent to the drive roll and the driven roll. Flares 312*a*, 314*a* help position the inflatable mailer into the receptacle. The inflatable mailer may be deposited into the receptacle by dropping the inflatable liner between the drive roll and the driven roll, when the drive roll is an open position. The inflatable mailer may be inserted automatically via an inventory supply device (not shown) or by manually dropping the inflatable mailer into the receptacle.

In some embodiments, the inflation device includes a sensor 320 such as photoelectric sensor that detects the presence of the mailer. In the illustrated embodiment, the sensor comprises a photoelectric sensor that detects the presence or absence of the mailer by viewing along a line of sight that extends through openings 316*a*, 316*b* that are present in the receptacles sidewalls 312, 314, respectively. The sensor may be in communication with a controller 322 that is operatively connected to the inflation device. The controller may be in communication with one or more sensors and may control the timing and operation of the inflation device.

Figure 8C:
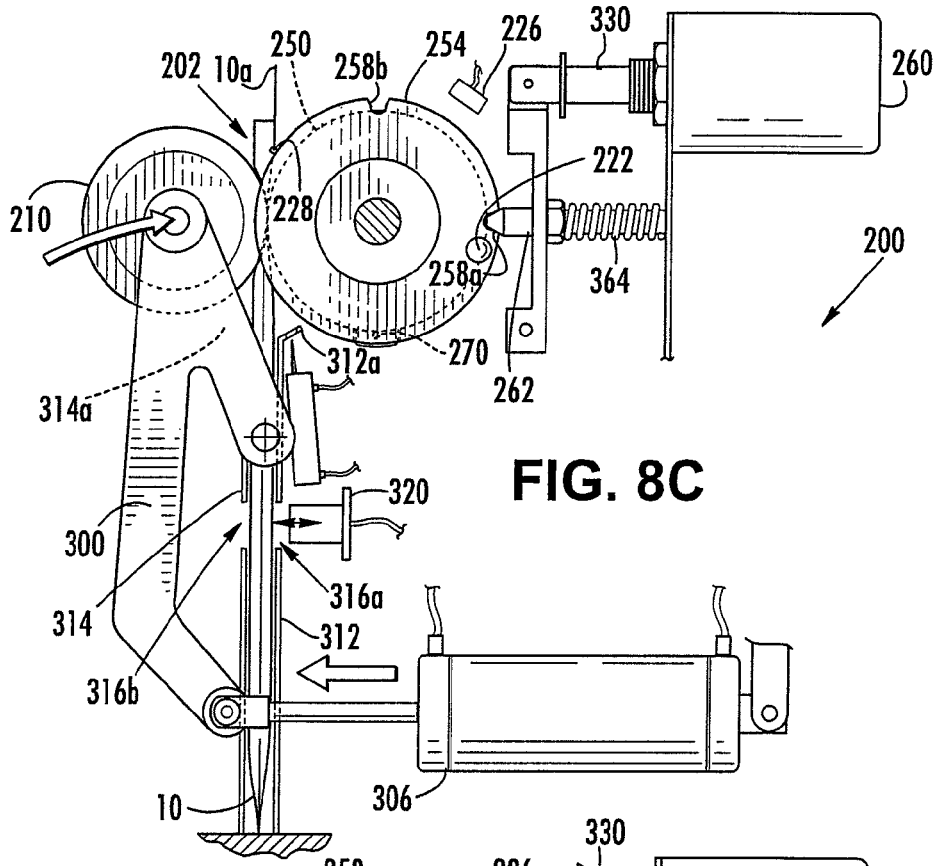

As shown in FIG. 8C, the sensor 320 detects the presence of the mailer 10 in the receptacle and may instruct the piston 306, either directly or indirectly, to move the drive roll 210 into the closed position. The drive roll 210 is moved into nipping contact with driven roll 250. Typically, the inflatable mailer is positioned in the receptacle so that the top portion 10*a* of the inflatable mailer is disposed between the drive roll and driven roll. Concurrently, or in a subsequent step, the drive roll 210 is instructed to begin forward rotation. Drive roll and driven roll cooperate to drive the inflatable mailer through the nip.

Figure 8D:
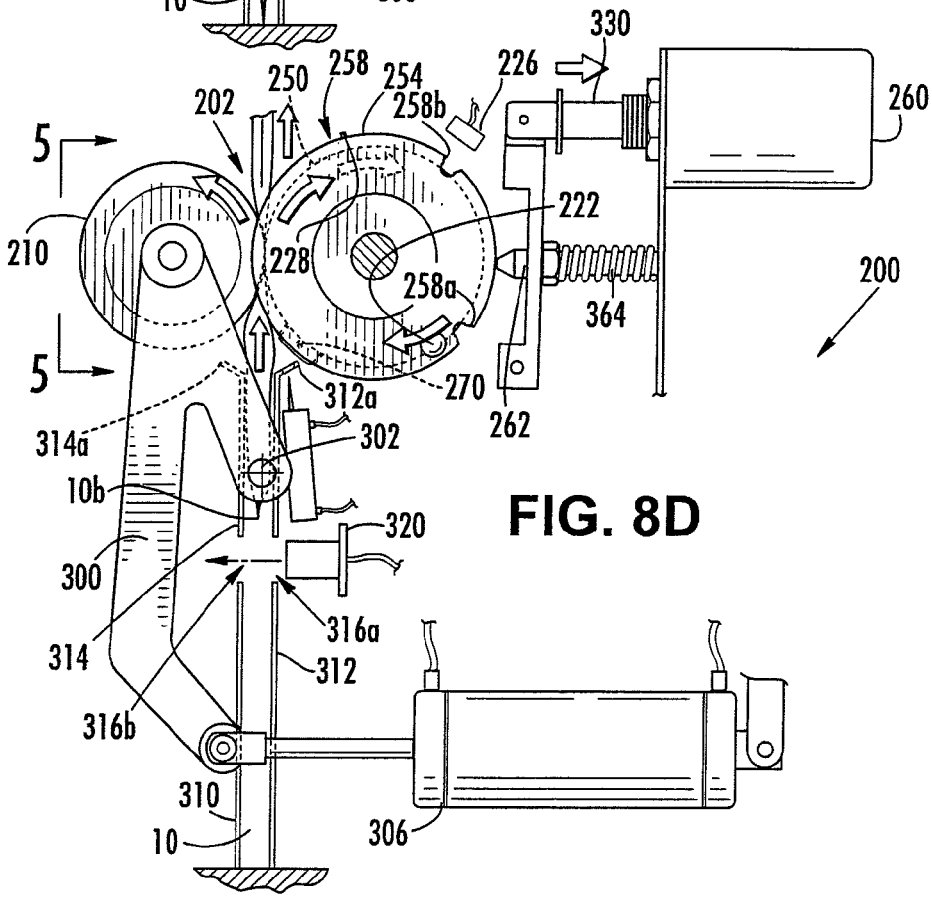

As the mailer moves between the rolls 210, 250, the controlled volume of gas moves through the inflatable chambers and begins to inflate the common channel to form the pre-bubble. In a preferred embodiment, sensor 320 is adapted to detect the trailing edge 10*b* of the mailer. After the trailing edge of the mailer has been detected, the sensor or controller at the appropriate moment may activate the solenoid 260 to disengage plunger 262 from recess 258*a*. In this regard, FIG. 8D illustrates rotation of the tubular roll 252, represent by the dashed arrows, and rotation of hub 254, represented by the non-dashed arrows. As shown, the indexing hub 254 is in the process of moving between the nominal position (see FIG. 8A) and the sealing position (see FIG. 8E). Preferably, activation of the solenoid 260 is timed so that the resistive wire 270 will be positioned between the rolls 210, 250 at about the same time that the inflatable mailer 10 is correctly positioned for inflation. Activation of the solenoid 260 causes solenoid arm 330 to retract in the direction of the arrow. As a result, the plunger 262 momentarily disengages the recess 258*a*. The friction members (see FIG. 7, reference number 342) cause the hubs and driven roller 250 to rotate together. The solenoid is typically activated only long enough for the plunger to disengage the recess 258*a*. The solenoid is then deactivated and spring 364 pushes the plunger into sliding contact with the outer circumferential surface 258 of the hub 254. The plunger rides in sliding contact along the surface 258 until it engages the second recess 258*b*, at which time, rotation of the hubs is stopped.

The hub may include a proximity switch that is adapted to detect when the resistive wire is correctly positioned between the rolls 210, 250. In this regard, a proximity sensor 226 is depicted as being disposed in a position adjacent to the hub 254. In some embodiments, the hub 254 includes a corresponding projection 228 that is detectable by the proximity switch. The position of the proximity sensor and projection 228 are such that when the resistive wire is positioned in the sealing position, the presence of the projection is detected by the proximity sensor. The proximity sensor may then send a signal to the controller indicating that the resistive wire is correctly aligned between rolls 210, 250. The controller may then stop the rotation of the drive roll. Preferably, the drive roll is stopped when the mailer is positioned between the rolls so that the resistive wire 270 extends laterally across the inflation conduits (see FIG. 2A, reference number 124). It should be understood that the position of the projection and the proximity sensor can be varied depending upon particular design preference. In some embodiments, the proximity sensor and corresponding projection may be associated with the distal hub.

Figure 8E:
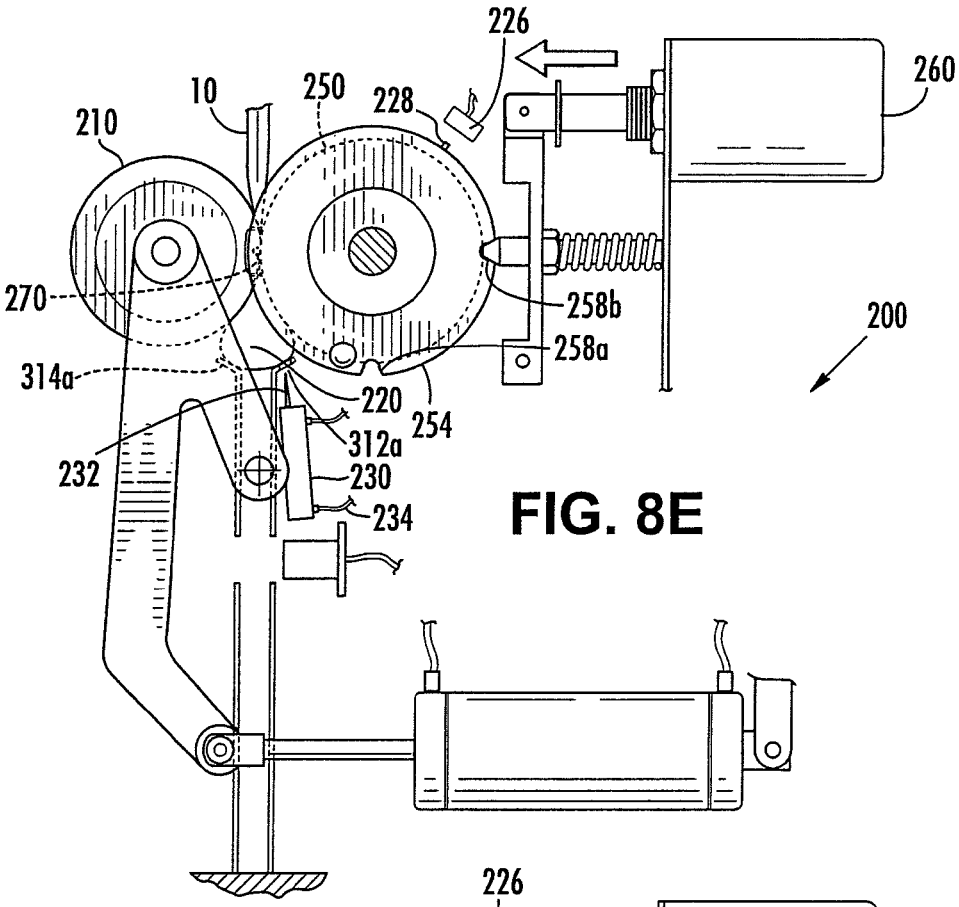

In FIG. 8E, the pre-bubble 220 is formed and the inflatable mailer is correctly positioned for inflation. In this position, the plunger has engaged the second recess 258*b* so that rotation of the hubs has ceased. The resistive wire is in the sealing position and disposed between rolls 210, 250. In addition, the proximity switch 226 has detected the presence of the projection 228 so that forward rotation of the drive roll 210 has stopped. Preferably, the pre-bubble is positioned just below rolls 210, 250 in close proximity to the nip point. In some embodiments, the pre-bubble 220 may be supported along its lower edges by flares 312*a*, 314*a*.

In the next steps, the controller directs one or more inflation nozzles 230 to puncture the pre-bubble and create puncture openings through which one or more inflation needles are removably inserted. The tip of the inflation needle is inserted through the pouch and into the common channel of the inflatable liner. In the illustrated embodiment, inflation nozzle 230 is disposed adjacent to one of the sidewalls of the receptacle 310. The inflation nozzle comprises an inflation needle 232, similar to a hypodermic needle, that is capable of being in fluid communication with a gas source, such as an air compressor. Inflation nozzle 230 typically includes fluid lines 234 that are adapted to be in fluid communication with the inflation nozzle and a gas source. The inflation nozzle may also include one or more actuators that move the inflation needle between a nominal position and an inflation position. In the inflation position, the needle is actuated so that it moves forward and pierces the pre-bubble with the tip of the needle disposed in the inflated common channel. The actuator typically comprises a pneumatic cylinder, electric solenoid, or the like that can be used to move the inflation needle between the nominal position and inflation position.

Figure 8F:
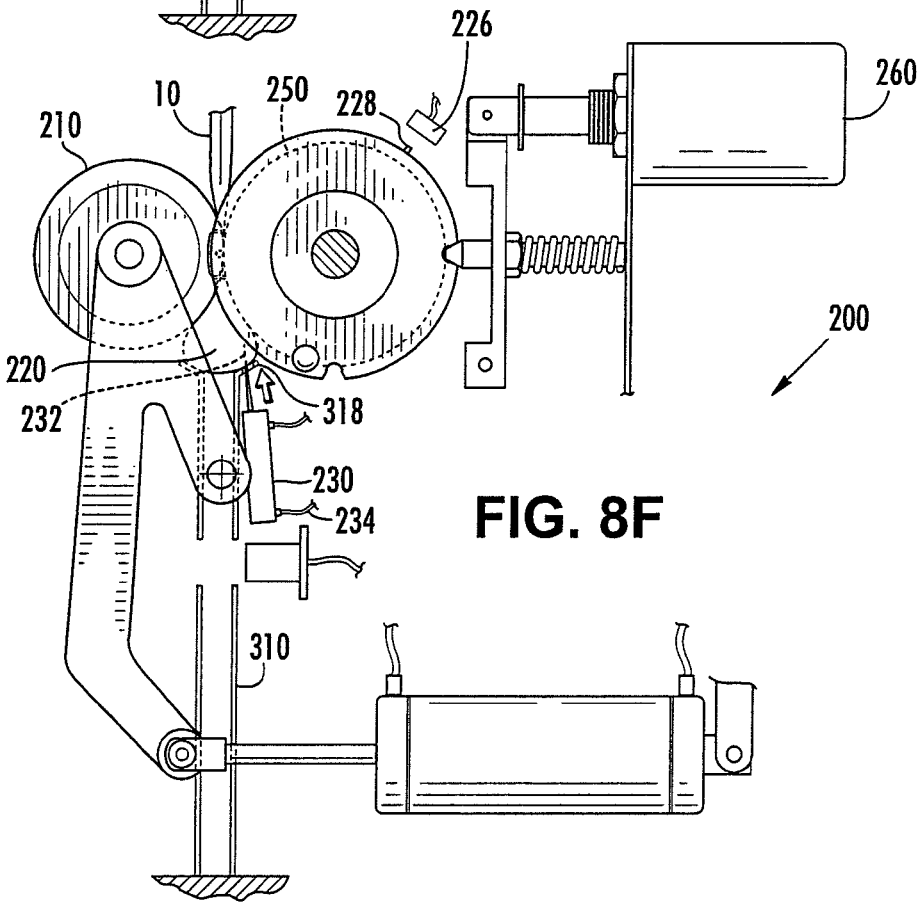
Figure 8G:
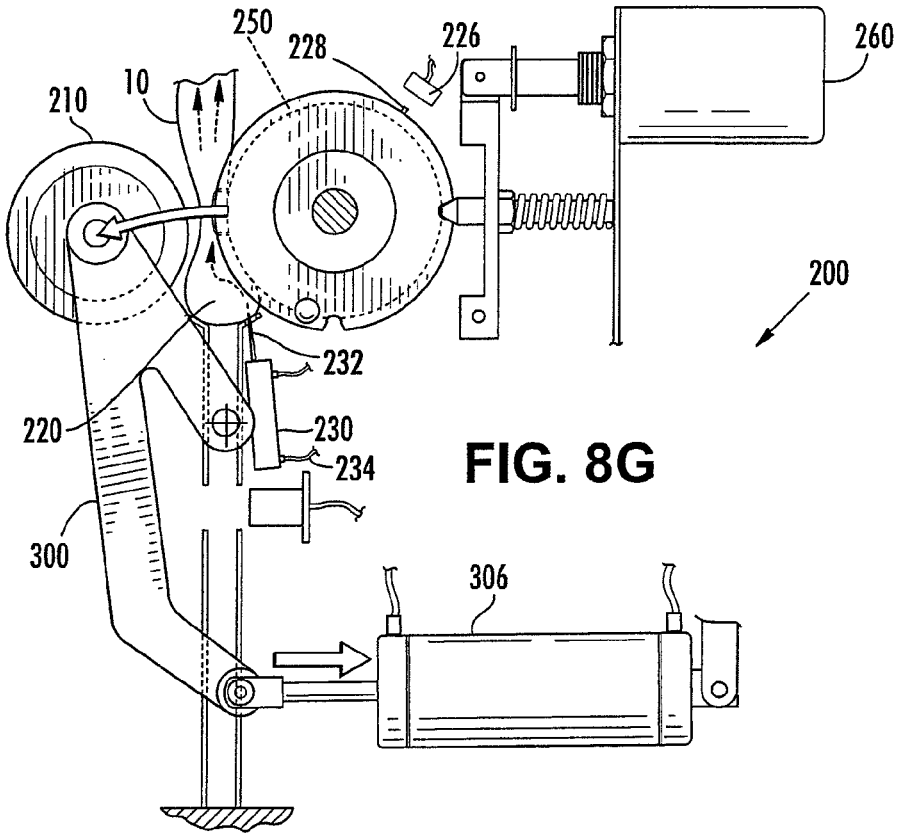

FIG. 8F illustrates the inflation needle being inserted into the pre-bubble. The inflation needle 232 may travel through an opening 318 formed in the receptacle 310. Preferably, the needle is inserted into the pre-bubble so that the tip extends into the common channel. In the next step, illustrated in FIG. 8G, the inflation needle introduces gas into the common channel. Typically, the drive roll is moved into the open position to help facilitate gas flow through the liner. The gas then flows from the common channel and fills the series of inflatable chambers. The gas may be supplied from an air compressor, gas tank, or other similar device. It should be recognized that in some embodiments, it may be possible to fill the inflatable liner while the drive roll is in the closed position, although not necessarily with equivalent results.

Typically, the liner is inflated to a pressure in the range from about 3 to 6 PSI, with about 3.5 PSI being somewhat more typical. In some embodiments, the inflation pressure may be controlled with one or more pressure regulators that inflate the liner at a desired pressure level. In other embodiments, the gas may be pulsed at high pressure. Gas flow and pressure into the liner may be controlled by "Pulse Width Modulation", or cycling the solenoid valves. When inflation starts, the gas pressure is pulsed by turning the gas flow on and off for relatively long periods, on the order of 1 second each. This allows a large volume of air to be pumped into the liner, followed by a pause that lets the pressure back down somewhat. During these cycles, the pressures may reach as high as 6 PSI and as low as 2 PSI. Pulsing may help to eliminate problems that can be associated with filling the liner. For example, in some embodiments, the liner may have a z-shaped fold along its edges resulting in up to 4 layers of inflatable web being present at the edges of the mailer. If one inflatable chamber fills too rapidly, it may block the channel behind it and stop it from inflating. Pulsation of the pressure helps to relax the front channel so that gas may enter the rear channel. Typically, once a channel begins to fill, it will fill completely. It typically takes 5 or 6 of these long pulses to fill the liner.

Once the liner is inflated, the final pressure must be achieved. This can be done by using shorter pulses. This is typically an on time of about 0.03 seconds and an off time of about 0.06 seconds, for a period of about 4 seconds. The short pulses minimize the difference between high and low pressures during the cycle and regulate the ultimate pressure, which is typically about 3.5 PSI. This pressure can be adjusted by changing the intervals. This final pressure is held until the roll 210 is moved into a closed position and, if necessary, during some or all of the seal cycle.

Figure 8H:
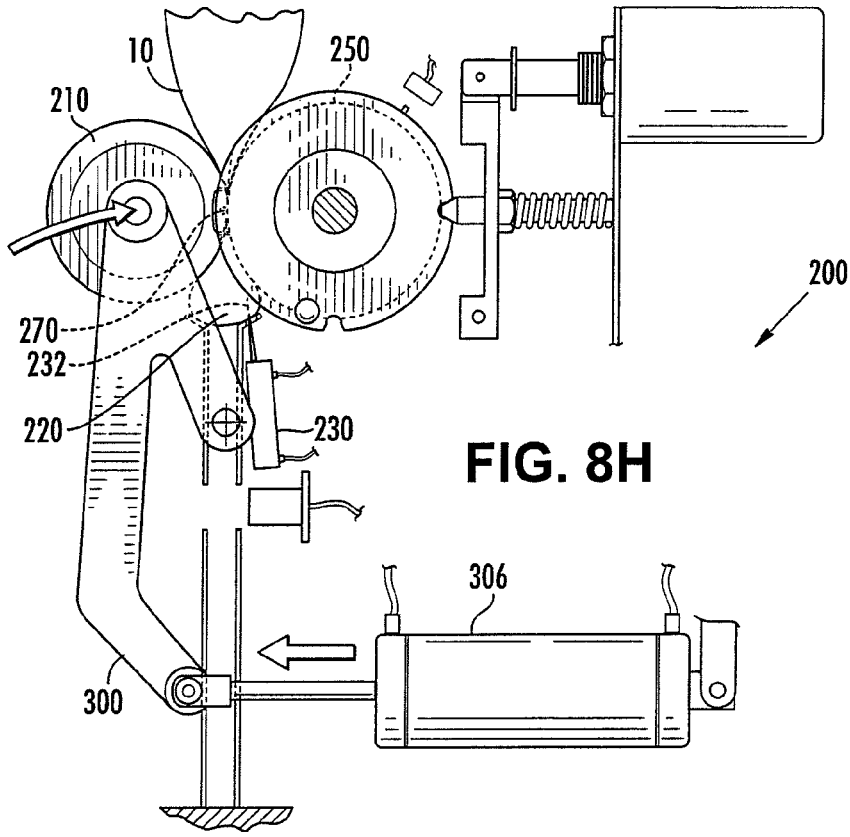

After the mailer has been inflated to a desired level, the drive roll 210 may be returned to the closed position (see FIG. 8H). As discussed above, returning the drive roll to the closed position facilitates creation of the heat seal and helps prevent gas escape before and during the sealing process. In some embodiments, the inflation needle is not returned to the nominal position until the seal is completed. In some instances, the pressure differential between the pre-bubble and the inflated mailer may cause the drive roll 210 to rotate backwards during the sealing step. This could result in damage to the seal. To overcome this problem, it may be necessary to keep the inflation needle disposed in the pre-bubble and under pressure until the sealing process is complete. Alternatively, the drive roll 210 may include a motor brake that prevents the undesired rotation of the roll.

Figure 8I:
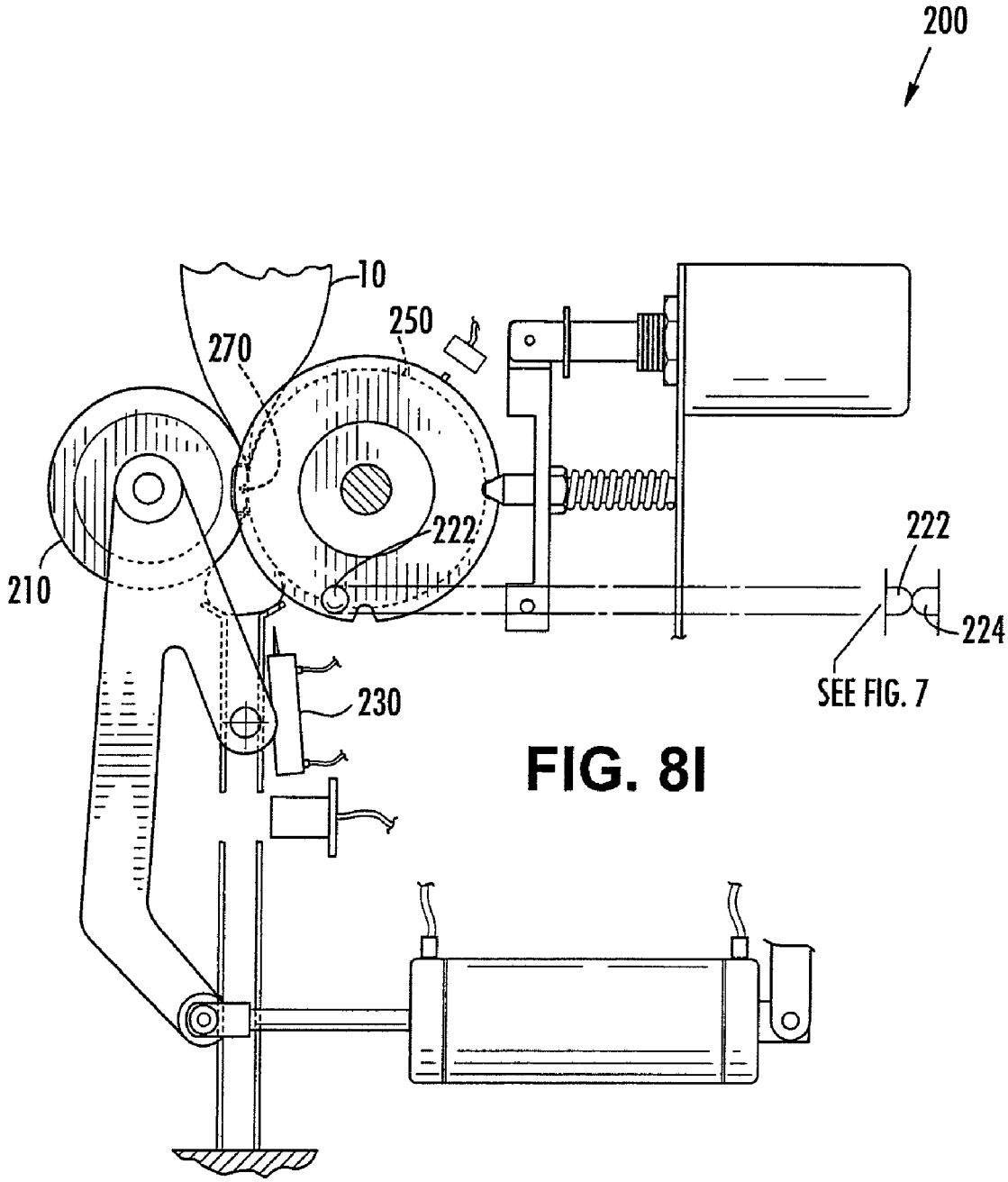

In FIG. 8I the inflation process has been completed and the controller directs electrical current to pass through contacts 222, 224 and into the resistive wire. As discussed above, contacts 222 and 224 are preferably disposed in such a relation that they contact each other when the resistive wire is disposed between the nip point. The current causes the resistive wire to heat and thereby melt and fuse the heated materials of the liner together. In a preferred embodiment, the resistive wire extends transversely across the inflation conduits so that each conduit is independently sealed. The amount of time required for sealing may be dependent upon many factors including the melting temperature of the film from which the liner is prepared, the heat conductivity of the mailer, resistance of the sealing device, the strength of the desired seal, and the like. Typically, the amount of time is about 3 to 6 seconds. The heat typically results in fusing the layers of the liner together and, in cases where the pouch comprises a thermoplastic material, fusing the liner to the pouch. This may be particularly advantageous for situations where it is desirable to have the liner be an inseparable part of the mailer.

In some embodiments, the resistive wire comprises an electrically resistive material, such as nichrome that produces heat as a result of electric current passing through the wire. The resistive wire may be formed from a variety of different materials including, but not limited to, metallic alloys such as nichrome, molybdenum, iron chrome aluminum, and $MoSi_2$. In embodiments where the pouch comprises a thermoplastic material it may be necessary to apply a release agent or coating such as silicone, or glass coating to the seal device to prevent unwanted adherence of the mailer to the resistive element. Preferably, the resistive wire is coated with a release agent, such as Teflon® that prevents the heated materials from adhering to the wire.

In some embodiments, the resistive wire may be in the form of a C-shaped wire that is adapted to create both transverse seals that extend the width of the liner and longitudinal seals that extend the width of the common channel. The C-shaped wire can be used to divide the liner into isolated segments at the points where the common channel is sealed along its width. As a result, deflation of one isolated segment will not necessarily result in deflation of the remaining isolated segments. In other embodiments, the sealing device may comprise one or more annular resistive elements that produce ring-shaped seals surrounding the puncture opening created by the inflation needle. In some embodiments, the sealing device may comprise a resistive bar that extends transversely along the length of roll 210 or roll 250. It should also be understood that alternative sealing methods can be used in conjunction with the invention including but not limited to, adhesion bonding, ultrasonic fusion, radio frequency bonding, and any other method that can be used to seal the liner.

Figure 8J:
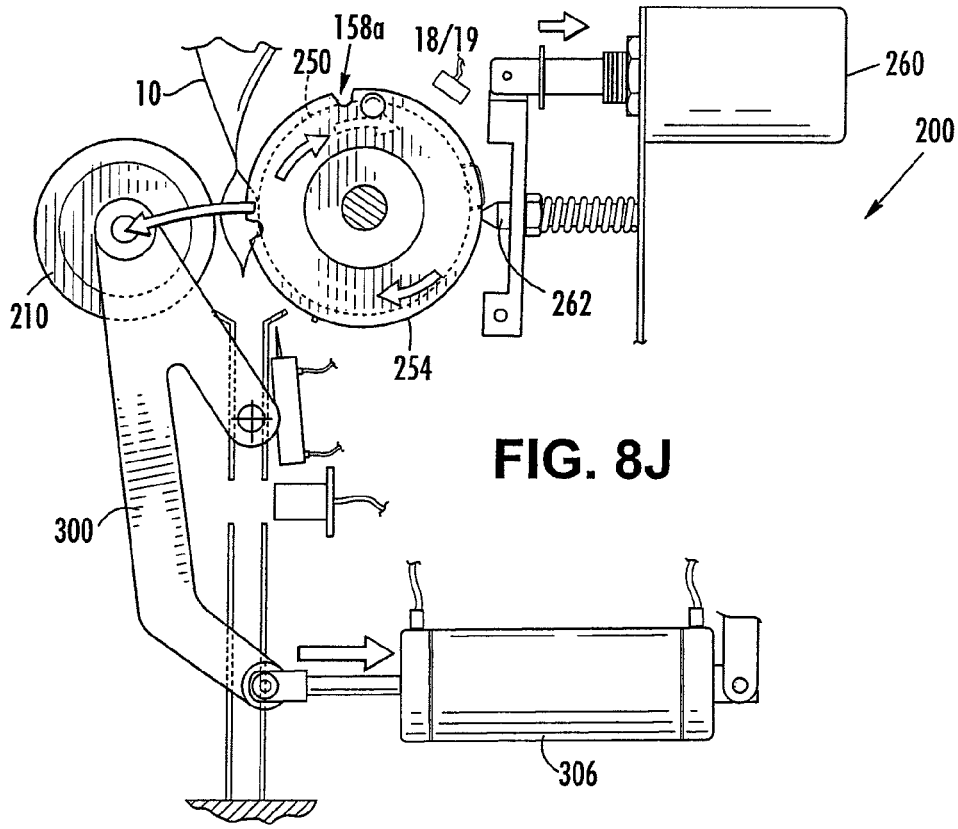
Figure 8K:
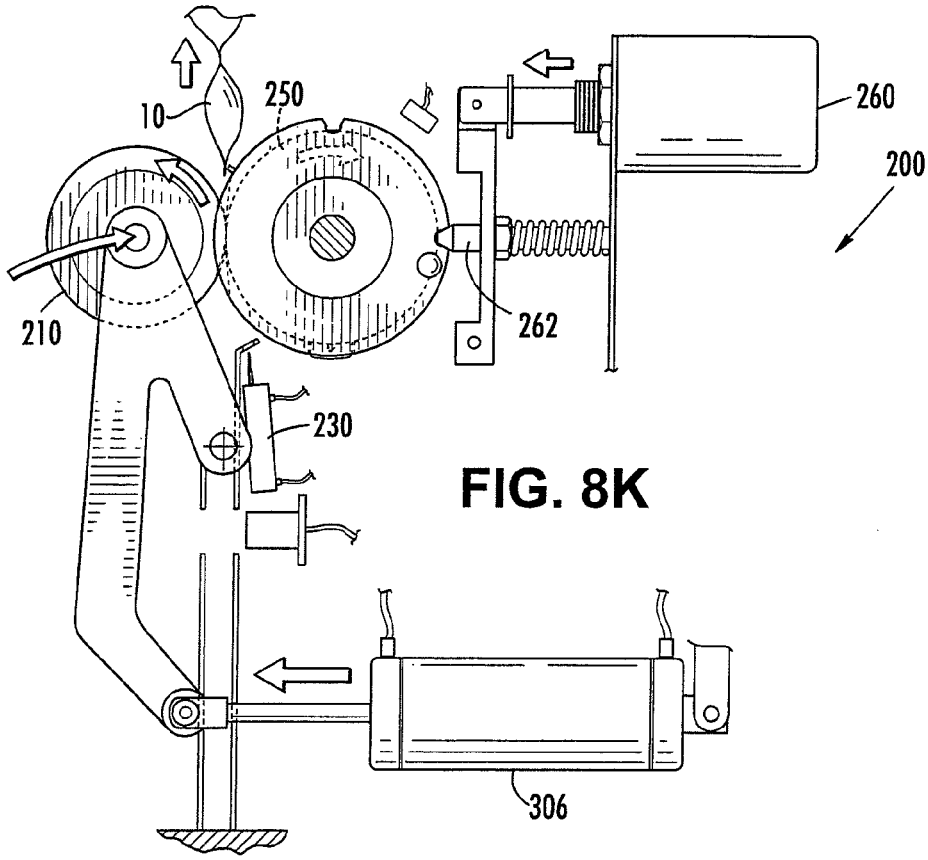

After the heat seal is formed, it may be desirable to allow the newly formed seal to cool for a second or two. After the seal is formed, the now inflated mailer is driven forward and is ready for use. The indexing mechanism is returned to the nominal position. As shown in FIG. 8J, the indexing mechanism is returned to the nominal position by activating the solenoid 260 so that the indexing hub is rotated until the plunger 262 engages the first recess 158*a*. The inflation device is now ready to inflate the next inflatable mailer (see FIG. 8K).

As discussed above, the inflation 200 may also comprise a controller 322 that is adapted for controlling the operations of the device, including the operation of the indexing mechanism, carriage assembly, drive roll, sealing device, and gas inflation needle. The controller 322 may receive and send the various status, activation, and control signals described below. Input/output connections and signal transmission lines between the controller 322 and the various sensors and devices that are operatively connected to the controller are not shown and are considered to be within the ordinary skill of the art. In some embodiments, the controller can also operate a mailer supply device that is adapted to supply the inflatable mailers to the conveying mechanism for subsequent inflation.

The controller 322 may comprise a programmable logic controller ("PLC"). The controller 322 may comprise one or more of a: 1) central processing unit ("CPU"), for example, comprising a microprocessor, to control the functions and operations of the controller, 2) memory storage including read only memory ("ROM"), random access memory ("RAM"), for example, 3) multiple input/output interfaces for receiving and sending signals, and other storage, display, and peripheral devices as known in the art. The controller 322 may also store and execute software control program code for carrying out the various control and monitoring functions described herein.

In some embodiments, the inflation device 200 may also comprise one or more sensors adapted to detect the presence or absence of an inflatable mailer, position of the sealing device, gas pressure, and send a corresponding status signal to controller 322. A sensor may comprise, for example, one or more of a photo-eye, an electric-eye, photo-detector, and a corresponding reflector, and the like.

Figure 9:
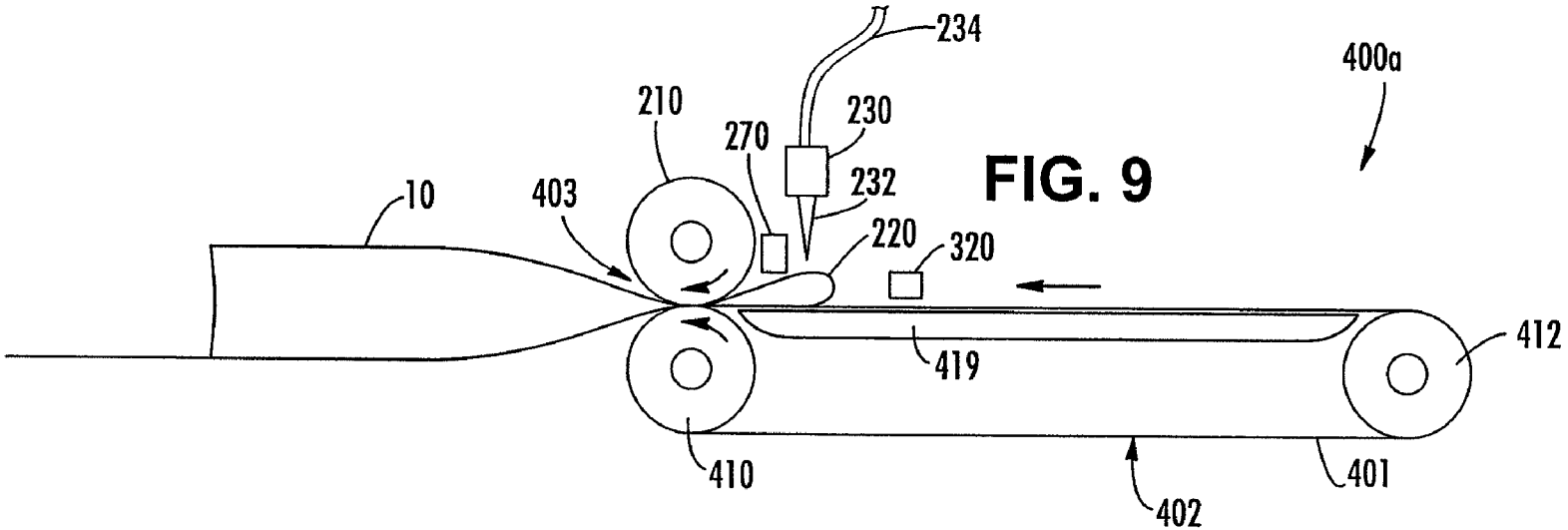
FIG. 9 is an alternative embodiment of the inflation device comprising a moveable belt.

In some embodiments, the inflation device includes a driven belt for the conveying mechanism. In this regard, FIG. 9 illustrates an alternative inflation device 400*a* comprising a driven belt 401 for conveying the inflatable mailer, a driven roll 210, a gas inflation needle 230, and a sealing device 270. In this embodiment, an inflatable mailer is presented on the belt. As discussed above, the inflatable mailer is preferably positioned on the belt so the common channel is disposed opposite the drive roll. Typically, the belt 401 comprises fiberglass that has been impregnated with Teflon® or a similar material that has the ability to handle elevated temperatures. In some embodiments, the belt 401 may have a release coating such as Teflon® disposed on its outer surface 402.

The driven belt includes at least two supporting rollers 410, 412. The belt is drawn between drive roll 210 and belt roll 410, which cooperate to form a nip at 403. As discussed above, travel of the inflatable mailer 10 between the nip causes the controlled volume of gas to move into common channel. A sensor 320, such as a photoelectric sensor, can be disposed along the belt to detect the end of the mailer. The sensor can be used to time the moment at which the inflation needle is inserted into the common channel. Inflation nozzle 230 comprises an inflation needle 232 that is used to puncture the inflated common channel. Typically, one of the rolls 210, 410 includes a surface comprising a soft material, such as silicone, that allows gas introduced by the inflation needle to flow between the nip and into the inflatable chambers.

The sealing device 270 may comprise a sealing bar that comprises an electrically resistive material. The sealing bar extends laterally across the belt so that a transverse seal is created across the inflatable liner. To seal the liner, sealing device 270 is pressed into sealing contact with the inflatable mailer. Typically, a rigid support member 419 is disposed adjacent to the inner surface of the belt to provide a surface to which the sealing device can be pressed against. In this manner, the inflatable mailer can be pressed between the support surface 419 and the sealing device 270. In an alternate embodiment, the sealing device could press down against the belt roller 410.

Figure 10:
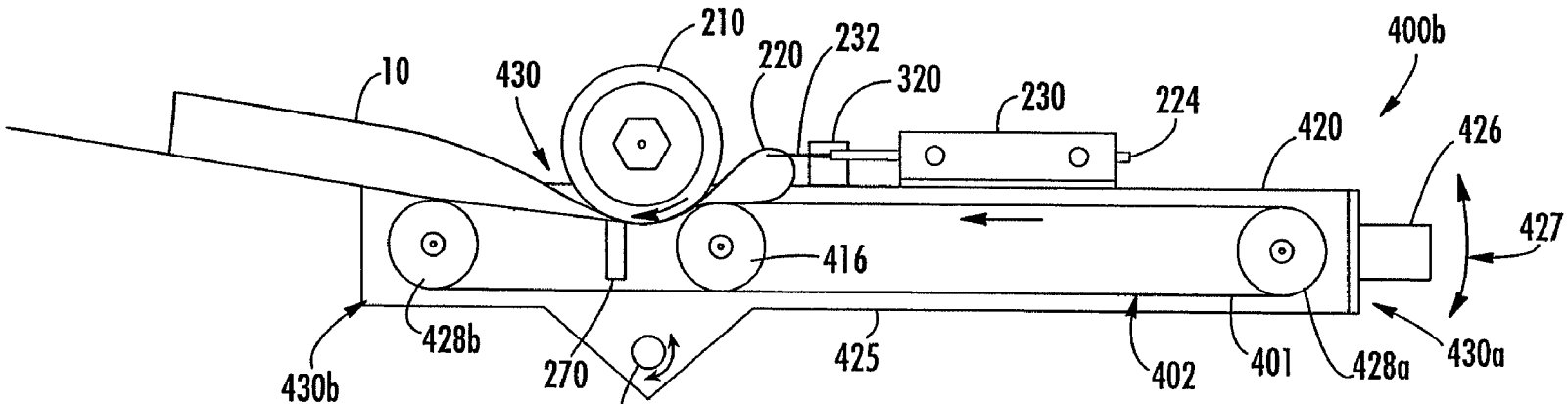
FIG. 10 is an alternative embodiment of the inflation device comprising a moveable belt that is supported by a moveable carriage.

An additional alternative embodiment is illustrated in FIG. 10 and broadly designated as reference number 400*b*. In this embodiment a driven belt 401 is supported by a moveable carriage assembly 420. The belt system includes at least two idler rolls 428*a*, 428*b* disposed at the proximal and distal ends of the belt 430*a*, 430*b*, respectively, and a driven idler roll 416 disposed between rolls 428*a* and 428*b*. The driven roll cooperates with drive roll 210 to form a nip therebetween at 430. A sensor 320, such as a photoelectric sensor, can be disposed along the belt to detect the end of the mailer. The sensor can be used to time the moment at which the inflation needle is inserted into the common channel. The carriage assembly allows the nip to move between a closed position and an open position to help facilitate inflation of the liner. The carriage system 420 comprises a frame 425 that supports the components of the inflation device. The frame may comprise sheet metal, plastic, or any other suitable material. The carriage system is typically attached to a lifting device (not shown) that is attached to the frame at 426. The lifting device may be selected from a variety of different mechanisms that are adapted to move the frame up and down as represented by arrow 427. Suitable lifting devices include pneumatic cylinders, electric solenoids, chain lift systems, presses, and the like.

In this embodiment, drive roll 210 and belt roll 416 cooperate to form a nip therebetween at 430. Idler rolls 428*a* and 428*b* support the driven belt. Roll 210 and roll 416 cooperate to form a nip therebetween. In this embodiment, movement of roll 210 is fixed relative to the carriage assembly. The carriage assembly includes a pivot point at 424 that is adjacent to the nip 430 formed by rolls 210, 416. The position of the pivot 424 is fixed relative to the movement of the carriage assembly. As a result movement of the carriage assembly allows the distance between rolls 210 and 416 to be varied depending upon the step to be performed. The carriage assembly is moveable to at least three separate positions. In a first position, the proximal end 430*a* of the carriage assembly may be slightly declined relative to roll 210 so that an open space exists between roll 210 and roll 416. The open space may help assist in feeding the inflatable mailer between the nip. In the uppermost position, the carriage assembly is moved upwardly to its highest position relative to the driven roll. In this position, roll 210 and roll 416 are in nipping contact so that forward travel of the inflatable mailer through the nip causes the controlled volume of gas to move in the direction of the common channel. Forward motion of the inflatable mailer produces the pre-bubble. After formation of the pre-bubble 220, forward motion is stopped and the inflation nozzle 230 is actuated so that the inflation needle 232 punctures the pre-bubble and the tip of the needle is inserted into the common channel. Gas flow through fluid conduit 234 introduces gas into the liner. Preferably, the pressure between rolls 210 and 416 during the inflation process is reduced by moving the carriage assembly into an intermediate position.

After inflation is completed, the distal end 430*b* of the carriage assembly is moved into a slightly elevated position. In this position, the proximal end of the carriage assembly at 426 is slightly declined with respect to rolls 210, 416, and sealing device 270. As a result, the sealing device comes into a pinching relationship with the drive roll 210 at 430. The sealing device typically comprises a resistive element, such as a nichrome heating element, that extends laterally across the width of the belt. The sealing device is activated so that thermal heat radiates through the belt and into the inflatable liner at the position where the sealing device and drive roll are in a pinching relationship. Once sealing is complete, the needle is removed and the now inflated mailer is driven forward.

As discussed previous, the apparatus for inflating the inflatable mailer may include a controller and various sensors for monitoring and controlling the inflation of the mailer. In some embodiments, the apparatus may also include an inventory supply device that automatically feeds an inflatable mailer into the conveying mechanism as needed. The inventory supply device may also be operatively connected to a controller. Typically, the inflation device will also include a protective casing (not shown) to enclose and protect the internal components of the device. The protective casing may comprise a variety of materials including plastic, sheet metal, and the like. It should be recognized that the dimensions and orientation of the inflation device can be varied depending upon the designer's particular preference, desired foot print, mailer size, and the like.

It should also be apparent from the preceding discussion that the invention comprises an improved shipping container that may occupy significantly less space than many conventional packaging materials. The invention is particularly suited for packaging environments in which numerous articles are being shipped. The compact size of the inflatable mailer make it ideally suited for situations where storage space is a minimum.

Many modifications and other embodiments of the invention set forth herein will come to mind to one skilled in the art to which the invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. An inflatable mailer comprising:

a) front and rear sheets arranged in opposing face-to-face relation and each including a top edge, a bottom edge, and opposite side edges, the sheets being interconnected along the bottom edge and along opposite side edges to define a mailer with an interior space capable of receiving an article, and wherein the top edges of the sheets are unconnected to form an opening into the interior space; and b) an inflatable liner disposed in said interior in a partially inflated state, said inflatable liner comprising:

i) two sheets having inner surfaces sealed to each other in a pattern defining a series of inflatable chambers and at least one common channel in fluid communication with said series of inflatable chambers; and ii) a controlled volume of gas dispersed throughout said inflatable chambers, wherein said volume of gas is insufficient to inflate the inflatable liner, but is sufficient to substantially inflate said common channel when the gas is moved from said inflatable chambers into said common channel, whereby an inflation pathway is created through which a second portion of gas can be introduced into said inflatable liner.

2. The inflatable mailer according to claim 1, wherein said series of inflatable channels extend longitudinally across said sheets in an oscillating pattern of repeating apexes and valleys.

3. An inflatable mailer according to claim 1, wherein a portion of said front sheet extends beyond said opening to define a flap, said flap having an adhesive and a release liner covering said adhesive.

4. An inflatable mailer according to claim 1, wherein said chambers comprise at least two inflatable sections of relatively large width connected by relatively narrow inflatable passageways.

5. An inflatable mailer according to claim 4, wherein the sections of relatively large width are circular and capable of forming essentially spherical or hemispherical bubbles when inflated.

6. An inflatable mailer according to claim 1, wherein each of said sheets comprises a heat-sealable thermoplastic polymer on its inner surface.

7. An inflatable mailer according to claim 1, wherein said pattern defining the inflatable chambers includes uninflatable planar regions between the inflatable chambers.

8. An inflatable mailer according to claim 1, wherein said common channel extends laterally along an edge of said liner and is disposed adjacent to a bottom edge of said mailer.

9. An inflatable mailer according to claim 1, wherein a bottom edge of said mailer includes one or more vents.

10. An inflatable mailer comprising:

a) front and rear sheets arranged in opposing face-to-face relation and each including a top edge), a bottom edge, and opposite side edges, the sheets being interconnected along the bottom edge and along opposite side edges to define a mailer with an interior space capable of receiving an article, and wherein the top edges of the sheets are unconnected to form an opening into the interior space; and b) an inflatable liner disposed in said interior in a partially inflated state, said inflatable liner comprising:

i) two sheets having inner surfaces sealed to each other in a pattern defining a series of inflatable chambers and at least one common channel in fluid communication with said series of inflatable chambers; and ii) a controlled volume of gas dispersed throughout said inflatable chambers, wherein said volume of gas is sufficient to substantially inflate said common channel when the gas is moved from said inflatable chambers into said common channel, but is insufficient to inflate the series of inflatable chambers so that the inflatable mailer is in a substantially compact state, whereby an inflation pathway is created through which a second portion of gas can be introduced into said inflatable mailer.

11. The inflatable mailer according to claim 10, wherein said series of inflatable channels extend longitudinally across said sheets in an oscillating pattern of repeating apexes and valleys.

12. An inflatable mailer according to claim 10, wherein a portion of said front sheet extends beyond said opening to define a flap, said flap having an adhesive and a release liner covering said adhesive.

13. An inflatable mailer according to claim 10, wherein said chambers comprise at least two inflatable sections of relatively large width connected by relatively narrow inflatable passageways.

14. An inflatable mailer according to claim 13, wherein the sections of relatively large width are circular and capable of forming essentially spherical or hemispherical bubbles when inflated.

15. An inflatable mailer according to claim 10, wherein each of said sheets comprises a heat-sealable thermoplastic polymer on its inner surface.

16. An inflatable mailer according to claim 10, wherein said pattern defining the inflatable chambers includes uninflatable planar regions (between the inflatable chambers.

17. A method of inflating an inflatable mailer comprising:

a) providing an inflatable mailer comprising:

(1) a pouch defining an opening through which an article can be placed into an interior space of said pouch; and (2) an inflatable liner disposed in said interior in a partially inflated state, said inflatable liner comprising:

i) two sheets having inner surfaces sealed to each other in a pattern defining a series of inflatable chambers and at least one common channel in fluid communication with said series of inflatable chambers; and ii) a controlled volume of gas dispersed throughout said inflatable chambers, wherein said volume of gas is sufficient to substantially inflate said common channel when the gas is moved from said inflatable chambers into said common channel, but is insufficient to inflate the series of inflatable chambers so that the inflatable mailer is in a substantially compact state, whereby an inflation pathway is created through which a second portion of gas can be introduced into said inflatable mailer;

b) moving said controlled volume of gas into said common channel;

c) introducing a second portion of gas into said common channel to fill said series of inflatable chamber; and d) sealing said inflatable chambers so that the second portion of gas is entrapped therein.

18. The method according to claim 17, wherein the step of moving said controlled volume of gas further comprises expanding said common channel to produce a fluid pathway.

19. The method according to claim 17, wherein the step of moving said controlled volume of gas further comprises passing said mailer between a nip whereby the nip moves the controlled volume of gas from said inflatable chambers into said common channel.

20. The method according to claim 17, wherein the step of introducing a second portion of gas further comprises piercing the common channel to create a puncture opening through which an inflation needle can be inserted.

* * * * *